US009788096B2

(12) United States Patent
Zhang et al.

(10) Patent No.: US 9,788,096 B2
(45) Date of Patent: Oct. 10, 2017

(54) TRANSMISSION METHOD, MOBILE TERMINAL, MULTI-CHANNEL HEADSET, AND AUDIO PLAY SYSTEM

(71) Applicant: Huawei Device Co., Ltd., Shenzhen (CN)

(72) Inventors: Zhiqiang Zhang, Shanghai (CN); Jianhui Jiang, Shenzhen (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 0 days.

(21) Appl. No.: 14/904,467

(22) PCT Filed: Apr. 21, 2015

(86) PCT No.: PCT/CN2015/077094

§ 371 (c)(1),
(2) Date: Jan. 12, 2016

(87) PCT Pub. No.: WO2015/165345

PCT Pub. Date: Nov. 5, 2015

(65) Prior Publication Data

US 2016/0157008 A1 Jun. 2, 2016

(30) Foreign Application Priority Data

Apr. 29, 2014 (CN) ..... 2014 1 0177198

(51) Int. Cl.
*H04R 1/10* (2006.01)
*H04R 5/04* (2006.01)
(Continued)

(52) U.S. Cl.
CPC ..... *H04R 1/1041* (2013.01); *H04R 5/04* (2013.01); *H04R 3/12* (2013.01); *H04R 5/033* (2013.01);
(Continued)

(58) Field of Classification Search
None
See application file for complete search history.

(56) References Cited

U.S. PATENT DOCUMENTS

2006/0258400 A1 11/2006 Lee
2008/0112572 A1 5/2008 Wong et al.
(Continued)

FOREIGN PATENT DOCUMENTS

CN 1496166 A 5/2004
CN 101006435 A 7/2007
(Continued)

OTHER PUBLICATIONS

"Mobile High-Definition Link," XP055159773, Retrieved from the Internet: URL: http://en.wikipedia.org/w/index.php?title=Mobile_High-Definition_Link&oldid=570703084 [retrieved on Dec. 19, 2014], Aug. 29, 2013, 6 pages.
(Continued)

*Primary Examiner* — Curtis Kuntz
*Assistant Examiner* — Kenny Truong
(74) *Attorney, Agent, or Firm* — Conley Rose, P.C.

(57) ABSTRACT

A transmission method, applied to a mobile terminal provided with a headset interface, is disclosed, where the method includes determining a type of a headset connected to the headset interface. If the headset is a multi-channel headset, an audio digital signal is transmitted to the headset using the headset interface. If the headset is not a multi-channel headset, an audio analog signal is transmitted to the headset using the headset interface. Further disclosed are a mobile terminal, a multi-channel headset, and an audio play system.

16 Claims, 9 Drawing Sheets

(51) Int. Cl.
*H04S 3/00* (2006.01)
*H04R 3/12* (2006.01)
*H04R 5/033* (2006.01)

(52) U.S. Cl.
CPC ..... *H04R 2420/05* (2013.01); *H04R 2420/07* (2013.01); *H04S 3/008* (2013.01)

(56) References Cited

U.S. PATENT DOCUMENTS

| | | | | |
|---|---|---|---|---|
| 2008/0228969 | A1 | 9/2008 | Cheah et al. | |
| 2008/0318518 | A1* | 12/2008 | Coutinho | H04H 20/62 455/3.06 |
| 2009/0060236 | A1* | 3/2009 | Johnston | H04R 3/12 381/304 |
| 2011/0116646 | A1 | 5/2011 | Sander et al. | |
| 2012/0265911 | A1 | 10/2012 | Connolly | |
| 2014/0105432 | A1 | 4/2014 | Jing et al. | |
| 2015/0304769 | A1* | 10/2015 | Weijand | H04R 1/1041 381/123 |

FOREIGN PATENT DOCUMENTS

| | | | |
|---|---|---|---|
| CN | 101179871 | A | 5/2008 |
| CN | 201290180 | Y | 8/2009 |
| CN | 201328181 | Y | 10/2009 |
| CN | 201504299 | U | 6/2010 |
| CN | 101945314 | A | 1/2011 |
| CN | 102111699 | A | 6/2011 |
| CN | 103139512 | A | 6/2013 |
| CN | 103945310 | A | 7/2014 |

OTHER PUBLICATIONS

Davies, C., "Sony HMZ-T3W wireless head-mounted display hands-on," XP055293152, Retrieved from the Internet: URL: http://www.slashgear.com/sony-hmz-t3w-wireless-head-mounted-display-hands-on-05296474 [retrieved on Aug. 3, 2016], Sep. 5, 2013, 3 pages.

Gsoedl, H., et al., "Market Status and Technology," New Multimedia Interface MHL, Rohde & Schwarz, Retrieved from the Internet: URL: http://www.digitimes.com/tw/tw/B2B/Seminar/Service/download/053A111150/053A111150_L3W75VDP41QSGY8G8JUQ.pdf [retrieved on Aug. 3, 2016], Nov. 2012, 37 pages.

Foreign Communication From a Counterpart Application, European Application No. 15786601.3, Extended European Search Report dated Aug. 11, 2016, 13 pages.

Partial English Translation and Abstract of Chinese Patent Application No. CN103945310, Jan. 18, 2016, 6 pages.

Partial English Translation and Abstract of Chinese Patent Application No. CN201290180, Jan. 18, 2016, 14 pages.

Partial English Translation and Abstract of Chinese Patent Application No. CN101945314, May 25, 2016, 7 pages.

Partial English Translation and Abstract of Chinese Patent Application No. CN1496166, Jun. 14, 2016, 18 pages.

Foreign Communication From a Counterpart Application, PCT Application No. PCT/CN2015/077094, English Translation of International Search Report dated Jul. 17, 2015, 2 pages.

Foreign Communication From a Counterpart Application, PCT Application No. PCT/CN2015/077094, Written Opinion dated Jul. 17, 2015, 5 pages.

Foreign Communication From a Counterpart Application, Chinese Application No. 201410177198.0, Chinese Office Action dated Jul. 9, 2015, 5 pages.

Foreign Communication From a Counterpart Application, Chinese Application No. 201410177198.0, Chinese Search Report dated Jun. 29, 2015, 2 pages.

Foreign Communication From a Counterpart Application, Chinese Application No. 201410177198.0, Chinese Office Action dated Apr. 5, 2016, 5 pages.

Foreign Communication From a Counterpart Application, Chinese Application No. 201410177198.0, Chinese Search Report dated Mar. 25, 2016, 2 pages.

* cited by examiner

TRANSMISSION METHOD, MOBILE TERMINAL, MULTI-CHANNEL HEADSET, AND AUDIO PLAY SYSTEM

CROSS-REFERENCE TO RELATED APPLICATIONS

This application is a National Stage of International Application No. PCT/CN2015/077094, filed on Apr. 21, 2015, which claims priority to Chinese Patent Application No. 201410177198.0, filed with the Chinese Patent Office on Apr. 29, 2014 and entitled "TRANSMISSION METHOD, MOBILE TERMINAL, MULTI-CHANNEL HEADSET, AND AUDIO PLAY SYSTEM", both of which are incorporated herein by reference in their entireties.

TECHNICAL FIELD

The present disclosure relates to the field of multimedia technologies, and in particular, to a transmission method, a mobile terminal, a multi-channel headset, and an audio play system.

BACKGROUND

With continuous development of multimedia technologies, people impose an increasingly high requirement on audio/video play, and people need a clearer image to improve visual enjoyment, and a multi-channel sound to improve auditory enjoyment. It has already been implemented that a computer device or a home theater can play multi-channel files. However, with high-speed growth of the mobile terminal market, people using a mobile terminal such as a mobile phone and a tablet computer are increasing, and when this part of users need to enjoy a multi-channel auditory effect, it is difficult to achieve the multi-channel auditory effect.

In the prior art, a common binaural headset is generally used to virtualize a multi-channel surround sound, an algorithm is used to perform encoding, so as to decompose a binaural audio file into six audio tracks such as a phase and a frequency band according to a phase, and then the six audio tracks are down mixed into a binaural audio file. A processor of a mobile terminal is used for processing during the entire process, and a binaural audio file is output at a backend, which can be implemented by using an existing headset interface. The virtualized surround sound may be understood as a sound effect obtained after processing. However, a source file is a binaural audio file, and a file that is output is also a binaural audio file, and therefore, a multi-channel effect is much poorer than a normal play effect of a real multi-channel audio file.

SUMMARY

To resolve a technical problem, embodiments of the present disclosure provide a transmission method, a mobile terminal, a multi-channel headset, and an audio play system, so as to resolve a problem that a real multi-channel play effect cannot be acquired on a headset end.

A first aspect of an embodiment of the present disclosure provides a transmission method, applied to a mobile terminal provided with a headset interface, where the method includes determining a type of a headset connected to the headset interface; if the headset is a multi-channel headset, transmitting an audio digital signal to the headset using the headset interface; and if the headset is not a multi-channel headset, transmitting an audio analog signal to the headset using the headset interface.

In a first possible implementation manner of the first aspect, the method further includes decoding a to-be-processed audio file to obtain an audio digital signal; and the transmitting an audio digital signal to the headset includes packing the audio digital signal into an audio data packet; and transmitting the audio data packet to the headset using the headset interface.

With reference to the first possible implementation manner of the first aspect, in a second possible implementation manner, before the packing the audio digital signal into an audio data packet, the method further includes performing DOLBY sound processing or DIGITAL THEATER SYSTEM sound processing on the audio digital signal; and the packing the audio digital signal into an audio data packet includes packing an audio digital signal, obtained after DOLBY sound processing or DIGITAL THEATER SYSTEM sound processing is performed, into an audio data packet.

With reference to the second possible implementation manner of the first aspect, in a third possible implementation manner, when the audio digital signal or the audio analog signal is being transmitted to the headset using the headset interface, transmission is performed using a sound channel pin of the headset interface.

With reference to the first aspect, or with reference to the first or second or third possible implementation manner of the first aspect, in a fourth possible implementation manner, the determining a type of a headset connected to the headset interface includes, when the headset is inserted into the headset interface, detecting ground impedance of a headset pin or a voltage value of a voltage detection point disposed on a headset pin, and identifying the type of the headset according to the ground impedance or the voltage value; or receiving headset type indication information entered by a user or sent by the headset, and determining the type of the headset according to the headset type indication information.

A second aspect of the present disclosure provides a transmission method, applied to a multi-channel headset that is inserted into a headset jack of a mobile terminal, where the method includes receiving an audio digital signal transmitted by the mobile terminal using the headset interface; converting the audio digital signal into an audio analog signal; and playing the audio analog signal.

In a first possible implementation manner of the second aspect, the method further includes receiving an audio data packet that carries the audio digital signal and is sent by the mobile terminal; unpacking the audio data packet to obtain the audio digital signal, and converting the audio digital signal into an audio analog signal; and playing the audio analog signal.

With reference to the first possible implementation manner of the second aspect, in a second possible implementation manner, before the converting the audio digital signal into an audio analog signal, the method further includes performing DOLBY sound processing or DIGITAL THEATER SYSTEM sound processing on the audio digital signal; and the converting the audio digital signal into an audio analog signal includes converting an audio digital signal, obtained after DOLBY sound processing or DIGITAL THEATER SYSTEM sound processing is performed, into an audio analog signal.

With reference to the second aspect, or with reference to the first or second or third possible implementation manner of the second aspect, in a fourth possible implementation manner, the method further includes receiving an audio analog signal sent by the mobile terminal using the headset interface; and playing the audio analog signal.

A third aspect of the present disclosure provides a mobile terminal, where the mobile terminal includes a processor, a digital-to-analog converter, a first switching circuit, and a headset interface, where the first switching circuit is connected to the headset interface; the processor is configured to decode an audio file to obtain an audio digital signal, determine a type of a headset connected to the headset interface, generate a first switching instruction according to the type of the headset, and transmit the first switching instruction to the first switching circuit, where if the headset is a multi-channel headset, the first switching instruction carries indication information used to instruct the first switching circuit to transmit an audio digital signal to the headset interface; if the headset is not a multi-channel headset, the first switching instruction carries indication information used to instruct the first switching circuit to transmit an audio analog signal to the headset interface; the digital-to-analog converter is configured to receive an audio digital signal from the processor, and convert the audio digital signal into the audio analog signal; the first switching circuit is configured to receive the first switching instruction, and transmit the audio digital signal or the audio analog signal to the headset interface according to the first switching instruction; and the headset interface is configured to transmit the audio digital signal to the headset or transmit the audio analog signal to the headset.

In a first possible implementation manner of the third aspect, the digital-to-analog converter is connected to the processor and the first switching circuit.

With reference to the first possible implementation manner of the third aspect, in a second possible implementation manner, the processor is further configured to pack the audio digital signal into an audio data packet, and directly send the audio data packet to the headset interface using the first switching circuit; and the headset interface is configured to transmit the audio data packet to the headset.

With reference to the second possible implementation manner of the third aspect, in a third possible implementation manner, the processor is further configured to, after obtaining the audio digital signal by means of decoding and before packing the audio digital signal into the audio data packet, perform DOLBY sound processing or DIGITAL THEATER SYSTEM sound processing on the audio digital signal.

With reference to the third aspect, or with reference to the first or second or third possible implementation manner of the third aspect, in a fourth possible implementation manner, the first switching circuit is configured to transmit the audio digital signal or the audio analog signal to a sound channel pin of the headset interface.

With reference to the third aspect, or with reference to the first or second or third or fourth possible implementation manner of the third aspect, in a fifth possible implementation manner, the mobile terminal further includes a voice processor, a power supply, and a second switching circuit, where the voice processor is configured to process sound information received from a microphone pin of the headset interface; the processor is further configured to output a second switching instruction to the second switching circuit according to the type of the headset connected to the headset interface, where if the headset is a multi-channel headset, the second switching instruction instructs the second switching circuit to connect the power supply and the microphone pin of the headset interface; if the headset is not a multi-channel headset, the second switching instruction instructs the second switching circuit to connect the voice processor and the microphone pin of the headset interface; and the second switching circuit is connected to the microphone pin of the headset interface, and is configured to receive the second switching instruction and switch the microphone pin of the headset interface according to the second switching instruction, such that the microphone pin of the headset interface is connected to the voice processor or the power supply.

With reference to the third aspect, or with reference to the first or second or third or fourth or fifth possible implementation manner of the third aspect, in a sixth possible implementation manner, the headset interface is a wired connection interface; the mobile terminal further includes a headset identification circuit, where the headset identification circuit is connected to the processor and is configured to, when the headset is inserted into the headset interface, detect ground impedance of a pin of the headset interface or a voltage value of a voltage detection point disposed on a headset pin; and the processor is further configured to identify the type of the headset according to the ground impedance or the voltage value.

With reference to the third aspect, or with reference to the first or second or third or fourth or fifth possible implementation manner of the third aspect, in a seventh possible implementation manner, the headset interface is a wireless connection interface; and the processor is further configured to receive headset type indication information sent by the headset, and determine the type of the headset according to the headset type indication information.

With reference to the third aspect, or with reference to the first or second or third or fourth or fifth possible implementation manner of the third aspect, in an eighth possible implementation manner, the mobile terminal further includes an input interface configured to receive headset type indication information entered by a user; and the processor is further configured to acquire the headset type indication information, and determine the type of the headset according to the headset type indication information.

With reference to the third aspect, or with reference to the first or second or third or fourth or fifth or sixth or seventh or eighth possible implementation manner of the third aspect, in a ninth possible implementation manner, after identifying the type of the headset interface and sending the first switching instruction, the processor decodes the audio file to obtain the audio digital signal.

With reference to the third aspect, or with reference to the first or second or third or fourth or fifth or sixth or seventh or eighth or ninth possible implementation manner of the third aspect, in a tenth possible implementation manner, the headset interface is a 3.5 millimeter (mm)/2.5 mm headset jack, the headset jack includes a left channel pin and a right channel pin, and the first switching circuit includes an analog switch, where a power input pin of the analog switch is connected to a working voltage, a ground pin of the analog switch is grounded, and a switching control pin of the analog switch is connected to a first signal output pin of the processor of the mobile terminal and is configured to receive the first switching instruction output by the processor; an output end of a first data output pin of the analog switch is connected to the left channel pin of the headset interface of the mobile terminal, and an output end of a second data output pin of the analog switch is connected to the right channel pin of the headset interface of the mobile terminal; and the analog switch further includes a first data input pin, a second data input pin, a third data input pin, and a fourth data input pin, where an input end of the first data input pin and an input end of the second data input pin are configured to receive the audio digital signal or the audio data packet, and input ends of the third data input pin and the fourth data input pin are configured to receive the audio analog signal, where if an audio digital signal or an audio data packet needs to be output, an input end of the first data output pin and an input end of the second data output pin are respectively connected to an output end of the first data input pin and an output end of the second data input pin, and if an audio analog signal needs to be output, the input end of the first data output pin and the input end of the second data output pin are respectively connected to an output end of the third data input pin and an output end of the fourth data input pin.

With reference to the fifth or sixth or seventh or eighth or ninth possible implementation manner of the third aspect, in an eleventh possible implementation manner, the headset interface is a 3.5 mm/2.5 mm headset jack, and the second switching circuit includes a first p-channel metal-oxide-semiconductor (PMOS) transistor and a second PMOS transistor, where a gate of the first PMOS transistor is connected to the microphone pin of the headset interface of the mobile terminal, a source of the first PMOS transistor is connected to the voice processor, and a drain of the first PMOS transistor is connected to a second signal output pin of the processor of the mobile terminal, where the second signal output pin is configured to output a level signal, so as to control on or off of the first PMOS transistor; a gate of the second PMOS transistor is connected to the microphone pin of the headset interface of the mobile terminal, a source of the second PMOS transistor is connected to the power supply, and a drain of the second PMOS transistor is connected to a third signal output pin of the processor of the mobile terminal, where the third signal output pin is configured to output a level signal, so as to control on or off of the second PMOS transistor.

A fourth aspect of the present disclosure provides a multi-channel headset, where the multi-channel headset includes a headset plug, a digital-to-analog converter, and a speaker, where the digital-to-analog converter is connected to the speaker; the headset plug is configured to receive an audio digital signal transmitted by a mobile terminal using the headset interface; the digital-to-analog converter is configured to convert the audio digital signal into an audio analog signal; and the speaker is configured to play the audio analog signal.

In a first possible implementation manner of the fourth aspect, the multi-channel headset further includes a third switching circuit, where the third switching circuit is connected to the headset plug; the headset plug is further configured to receive an audio analog signal sent by the mobile terminal using the headset interface; and the third switching circuit is configured to connect the headset plug and the speaker, and send the audio analog signal to the speaker; or connect the headset plug and the digital-to-analog converter, and send the audio digital signal to the digital-to-analog converter.

With reference to the first possible implementation manner of the fourth aspect, in a second possible implementation manner of the fourth aspect, the multi-channel headset further includes a processor, and the processor is connected between the third switching circuit and the digital-to-analog converter; the headset plug is configured to receive an audio data packet that carries the audio digital signal and is sent by the mobile terminal; and the processor is configured to unpack the audio data packet to obtain the audio digital signal, and send the audio digital signal to the digital-to-analog converter.

With reference to the first possible implementation manner of the fourth aspect, in a third possible implementation manner, the processor is further configured to, before sending the audio digital signal to the digital-to-analog converter, perform DOLBY sound processing or DIGITAL THEATER SYSTEM sound processing on the audio digital signal, and send an audio digital signal obtained after DOLBY sound processing or DIGITAL THEATER SYSTEM sound processing is performed to the digital-to-analog converter.

With reference to the fourth aspect, or the first or second or third possible implementation manner of the fourth aspect, in a fourth possible implementation manner, the multi-channel headset further includes a fourth switching circuit, a microphone, and a power supply circuit, where the fourth switching circuit is connected to the headset plug, and is configured to connect a microphone pin of the headset plug and the microphone or the power supply circuit; the microphone is configured to receive sound information; and the power supply circuit is configured to transmit electric quantity to the multi-channel headset.

With reference to the fourth aspect, or the first or second or third possible implementation manner of the fourth aspect, in a fifth possible implementation manner, the multi-channel headset further includes a power supply circuit and a power supply, where the power supply circuit is connected to the power supply, and is configured to transmit electric quantity to the multi-channel headset; and the power supply is configured to provide electric energy.

A fifth aspect of the present disclosure provides an audio play system, including a mobile terminal and a multi-channel headset, where a first processor, a first digital-to-analog converter, a first switching circuit, and a headset interface, where the first switching circuit is connected to the headset interface; the first processor is configured to decode an audio file to obtain an audio digital signal, determine a type of a headset connected to the headset interface, generate a first switching instruction according to the type of the headset, and transmit the first switching instruction to the first switching circuit, where if the headset is a multi-channel headset, the first switching instruction carries indication information used to instruct the first switching circuit to transmit an audio digital signal to the headset interface; if the headset is not a multi-channel headset, the first switching instruction carries indication information used to instruct the first switching circuit to transmit an audio analog signal to the headset interface; the first digital-to-analog converter is configured to receive an audio digital signal from the first processor, and convert the audio digital signal into a first audio analog signal; the first switching circuit is configured to receive the first switching instruction, and transmit the audio digital signal or the first audio analog signal to the headset interface according to the first switching instruction; and the headset interface is configured to transmit the audio digital signal to the headset or transmit the first audio analog signal to the headset; and the multi-channel headset includes a headset plug, a second digital-to-analog converter, and a speaker, where the second digital-to-analog converter is connected to the speaker; the headset plug is configured to receive an audio digital signal transmitted by the mobile terminal using the headset interface; the second digital-to-analog converter is configured to convert the audio digital signal into a second audio analog signal; and the speaker is configured to play the second audio analog signal.

In a first possible implementation manner of the fifth aspect, the first digital-to-analog converter is connected to the first processor and the first switching circuit; the multi-channel headset further includes a third switching circuit, where the third switching circuit is connected to the headset plug; the headset plug is further configured to receive an audio analog signal sent by the mobile terminal using the headset interface; and the third switching circuit is configured to connect the headset plug and the speaker, and send the first audio analog signal to the speaker; or connect the headset plug and the second digital-to-analog converter, and send the audio digital signal to the second digital-to-analog converter.

With reference to the first possible implementation manner of the fifth aspect, in a second possible implementation manner, the first processor is further configured to pack the audio digital signal into an audio data packet, and directly send the audio data packet to the headset interface using the first switching circuit; the headset interface is configured to transmit the audio data packet to the multi-channel headset; the multi-channel headset further includes a second processor, where the second processor is connected between the third switching circuit and the second digital-to-analog converter; the headset plug is configured to receive an audio data packet that carries the audio digital signal and is sent by the mobile terminal; and the second processor is configured to unpack the audio data packet to obtain the audio digital signal, and send the audio digital signal to the second digital-to-analog converter.

With reference to the second possible implementation manner of the fifth aspect, in a third possible implementation manner, the first processor is further configured to, after obtaining the audio digital signal by means of decoding and before packing the audio digital signal into the audio data packet, perform DOLBY sound processing or DIGITAL THEATER SYSTEM sound processing on the audio digital signal; or the second processor is further configured to, before sending the audio digital signal to the second digital-to-analog converter, perform DOLBY sound processing or DIGITAL THEATER SYSTEM sound processing on the audio digital signal, and send an audio digital signal obtained after DOLBY sound processing or DIGITAL THEATER SYSTEM sound processing is performed to the second digital-to-analog converter.

With reference to the fifth aspect, or with reference to the first or second or third possible implementation manner of the fifth aspect, in a fourth possible implementation manner, the first switching circuit is configured to transmit the audio digital signal or the audio analog signal to a sound channel pin of the headset interface.

With reference to the fifth aspect, or with reference to the first or second or third or fourth possible implementation manner of the fifth aspect, in a fifth possible implementation manner, the mobile terminal further includes a voice processor, a power supply, and a second switching circuit, where the voice processor is configured to process sound information received from a microphone pin of the headset interface; the first processor is further configured to output a second switching instruction to the second switching circuit according to the type of the headset connected to the headset interface, where if the headset is a multi-channel headset, the second switching instruction instructs the second switching circuit to connect the power supply and the microphone pin of the headset interface; if the headset is not a multi-channel headset, the second switching instruction instructs the second switching circuit to connect the voice processor and the microphone pin of the headset interface; and the second switching circuit is connected to the microphone pin of the headset interface, and is configured to receive the second switching instruction and switch the microphone pin of the headset interface according to the second switching instruction, such that the microphone pin of the headset interface is connected to the voice processor or the power supply; and the multi-channel headset further includes a fourth switching circuit, a microphone, and a power supply circuit, where the fourth switching circuit is connected to the headset interface, and is configured to connect the microphone pin of the headset interface and the microphone or the power supply circuit; the microphone is configured to receive sound information; and the power supply circuit is configured to transmit electric quantity to the multi-channel headset.

With reference to the fifth aspect, or with reference to the first or second or third or fourth possible implementation manner of the fifth aspect, in a sixth possible implementation manner, the multi-channel headset further includes a power supply circuit and a power supply, where the power supply circuit is connected to the power supply, and is configured to transmit electric quantity to the multi-channel headset; and the power supply is configured to provide electric energy.

With reference to the fifth aspect, or with reference to the first or second or third or fourth or fifth or sixth possible implementation manner of the fifth aspect, in a seventh possible implementation manner, the headset interface is a wired connection interface; the mobile terminal further includes a headset identification circuit, where the headset identification circuit is connected to the first processor and is configured to, when the headset is inserted into the headset interface, detect ground impedance of a pin of the headset interface or a voltage value of a voltage detection point disposed on a headset pin; and the first processor is further configured to identify, according to the ground impedance or the voltage value, the type of the headset inserted into the headset interface.

With reference to the fifth aspect, or with reference to the first or second or third or fourth or fifth or sixth possible implementation manner of the fifth aspect, in an eighth possible implementation manner, the headset interface is a wireless connection interface; and the first processor is further configured to receive headset type indication information sent by the headset connected to the headset interface, and determine the type of the headset according to the headset type indication information.

With reference to the fifth aspect, or with reference to the first or second or third or fourth or fifth or sixth possible implementation manner of the fifth aspect, in a ninth possible implementation manner, the mobile terminal further includes an input interface configured to receive headset type indication information entered by a user; and the first processor is further configured to acquire the headset type indication information, and determine, according to the headset type indication information, the type of the headset connected to the headset interface.

With reference to the fifth aspect, or with reference to the first or second or third or fourth or fifth or sixth or seventh or eighth or ninth possible implementation manner of the fifth aspect, in a tenth possible implementation manner, after identifying the type of the headset interface and sending the first switching instruction, the first processor decodes the audio file to obtain the audio digital signal.

With reference to the fifth aspect, or with reference to the first or second or third or fourth or fifth or sixth or seventh or eighth or ninth or tenth possible implementation manner of the fifth aspect, in an eleventh possible implementation manner, the headset interface is a 3.5 mm/2.5 mm headset jack, where the headset jack includes a left channel pin and a right channel pin; and the first switching circuit includes an analog switch, where a power input pin of the analog switch is connected to a working voltage, a ground pin of the analog switch is grounded, and a switching control pin of the analog switch is connected to a first signal output pin of the first processor of the mobile terminal and is configured to receive the first switching instruction output by the first processor; an output end of a first data output pin of the analog switch is connected to the left channel pin of the headset interface of the mobile terminal, and an output end of a second data output pin of the analog switch is connected to the right channel pin of the headset interface of the mobile terminal; and the analog switch further includes a first data input pin, a second data input pin, a third data input pin, and a fourth data input pin, where an input end of the first data input pin and an input end of the second data input pin are configured to receive the audio digital signal or the audio data packet, and input ends of the third data input pin and the fourth data input pin are configured to receive the audio analog signal, where if an audio digital signal or an audio data packet needs to be output, an input end of the first data output pin and an input end of the second data output pin are respectively connected to an output end of the first data input pin and an output end of the second data input pin, and if an audio analog signal needs to be output, the input end of the first data output pin and the input end of the second data output pin are respectively connected to an output end of the third data input pin and an output end of the fourth data input pin.

With reference to the fifth or sixth or seventh or eighth or ninth or tenth possible implementation manner of the fifth aspect, in a twelfth possible implementation manner, the headset interface is a 3.5 mm/2.5 mm headset jack; and the second switching circuit includes a first PMOS transistor and a second PMOS transistor, where a gate of the first PMOS transistor is connected to the microphone pin of the headset interface of the mobile terminal, a source of the first PMOS transistor is connected to the voice processor, and a drain of the first PMOS transistor is connected to a second signal output pin of the first processor of the mobile terminal, where the second signal output pin is configured to output a level signal, so as to control on or off of the first PMOS transistor; a gate of the second PMOS transistor is connected to the microphone pin of the headset interface of the mobile terminal, a source of the second PMOS transistor is connected to the power supply, and a drain of the second PMOS transistor is connected to a third signal output pin of the first processor of the mobile terminal, where the third signal output pin is configured to output a level signal, so as to control on or off of the second PMOS transistor.

To implement the embodiments of the present disclosure, a type of a headset connected to a headset interface is determined, and a different transmission channel may be used according to the type of the headset to transmit a different type of signal; for a multi-channel headset, an audio digital signal is transmitted, which can implement obtaining of a real multi-channel audio on a headset side, and therefore implement a multi-channel play effect.

BRIEF DESCRIPTION OF DRAWINGS

To describe the technical solutions in the embodiments of the present disclosure or in the prior art more clearly, the following briefly introduces the accompanying drawings required for describing the embodiments or the prior art. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly and completely describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
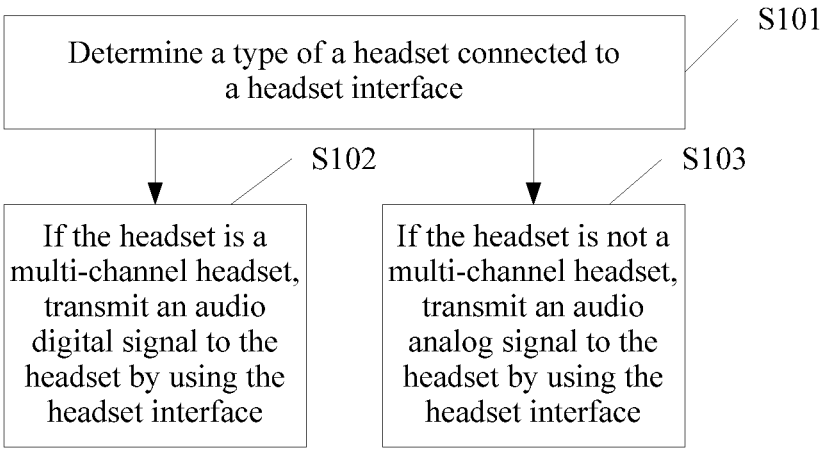
FIG. 1 is a schematic flowchart of a first embodiment of a transmission method according to the present disclosure.

Referring to FIG. 1, FIG. 1 is a schematic flowchart of a first embodiment of a transmission method according to the present disclosure. In this embodiment, the method is applied to a mobile terminal provided with a headset interface and includes the following steps.

S101. Determine a type of a headset connected to the headset interface.

More specifically, the type of the headset may be classified into a multi-channel headset, a binaural headset, and a monaural headset. When a user uses different types of headsets, data or signal transmission manners and channels are different, and therefore, when a headset is inserted into the headset interface, a type of the headset needs to be determined.

Optionally, the following manners may be used to determine the type of the headset.

When the headset is inserted into the headset interface, ground impedance of a headset pin is detected, and the type of the headset is identified according to the ground impedance; or a voltage detection point is disposed on a headset pin of the headset interface; when the headset is inserted into the headset interface, a voltage value of the voltage detection point is detected, and the type of the headset is identified according to the voltage value, where the headset pin on which the voltage detection point is disposed may be a left channel pin, a right channel pin, or a microphone pin; or headset type indication information entered by a user is received; when the headset is inserted into the headset interface, the type of the headset is determined according to the headset type indication information; or headset type indication information sent by the headset is received, and the type of the headset is determined according to the headset type indication information.

When the manner in which the ground impedance of the pin is detected is used, the detected headset pin may be the left channel pin, the right channel pin, or the microphone pin. If the manner in which the headset type indication information entered by the user is received is used to determine the type of the headset, the user may first enter the headset type indication information into the mobile terminal, and then insert the headset, so as to implement determining of the type of the headset; or the user may first insert the headset, and then the mobile terminal prompts the user to input the headset type indication information, so as to implement determining of the type of the headset.

S102. If the headset is a multi-channel headset, transmit an audio digital signal to the headset using the headset interface.

A to-be-processed audio file may be a 4.1-channel audio file, a 5.1-channel audio file, a 6.1-channel audio file, a 7.1-channel audio file, or an audio file of more channels that may emerge subsequently, which is not limited herein.

A headset interface of an existing mobile terminal such as a mobile phone or a tablet computer has a maximum of four pins, that is, a left channel pin, a right channel pin, a ground pin, and a microphone pin, where the ground pin is generally configured to perform grounding, but is not configured to transmit data. Therefore, if transmission is performed according to a conventional multi-channel audio transmission manner, that is, each pin transmits one audio signal, the four pins of the headset interface cannot directly transmit multiple audio digital signals obtained by decoding a multi-channel audio file. For example, there are six independent audio signals obtained by decoding a 5.1-channel audio file, and the four pins cannot meet transmission requirements. Therefore, an additional switching circuit may be disposed in the mobile terminal, or the headset interface of the mobile terminal may be directly transformed. The switching circuit and a circuit of the headset interface are integrated, and then an audio transmission channel is switched to a channel on which the switching circuit is corresponding to a data interface and the headset interface, where a transmitted signal is an audio digital signal. Multiple audio digital signals may be transmitted after being packed.

Optionally, when an audio data packet is being transmitted to a headset interface, transmission may be performed using a Universal Serial Bus (USB) or a Sony/Philips Digital Interface Format (SPDIF). Another available interface may be used, and the present disclosure does not set any limitation thereto.

For example, when the USB is used to transmit a 5.1-channel audio file, the 5.1-channel audio file may be first decoded to obtain six audio digital signals, and then the six audio digital signals are packed to obtain an audio data packet. Optionally, a packing quantity may be one or more, and then the USB is used to perform transmission. Two data transmission pins, one ground pin, and one power supply pin need to be used simultaneously according to a USB transmission protocol. Therefore, four pins of a headset interface need to be occupied simultaneously. When transmission is performed using another interface, a quantity of pins occupied may be different, and it only needs to be ensured that the quantity of pins occupied is less than or equal to 4; then the audio data packet is transmitted to a headset using the headset interface. If the packing quantity is greater than 1, a transmission channel keeps unchanged to perform continuous transmission for multiple times. In this way, a purpose of transmitting a data packet, obtained by decoding and packing a multi-channel audio file, to a headset side is implemented.

It should be noted that when a quantity of audio digital signals obtained by decoding an audio file is less than or equal to a quantity of current transmission lines, an audio digital signal obtained by means of decoding can be directly transmitted to the headset end, and does not need to be packed.

S103. If the headset is not a multi-channel headset, transmit an audio analog signal to the headset using the headset interface.

More specifically, when it is determined that the headset inserted into the headset interface is not a multi-channel headset, for example, a monaural headset or a binaural headset, in this case, one or two audio analog signals are obtained according to a normal processing procedure such as performing digital-to-analog conversion processing on an audio digital signal obtained by means of decoding, and a corresponding pin in the four pins of the existing headset interface is used to complete transmission of the audio analog signal.

It should be noted that in this embodiment, to facilitate use and reduce transformation of an existing device, the headset interface may be a 3.5 mm headset jack, a 2.5 mm headset jack, or a USB headset jack, or may even be a Bluetooth® headset or a WiFi headset connected wirelessly. At the same time, a headset plug needs to be set to match a corresponding interface on the mobile terminal.

For example, when the headset interface is a 2.5 mm headset jack, an internal circuit of the 2.5 mm headset jack is basically the same as that of a common 3.5 mm headset jack. Therefore, a switching circuit same as a switching circuit of the 3.5 mm headset jack may be disposed in the mobile terminal, or the switching circuit and a circuit of the 2.5 mm headset jack are integrated; at the same time, a size of the headset plug is set to 2.5 mm. A processing manner of a USB interface is similar, which is not described herein again.

However, for a wirelessly connected headset such as a Bluetooth® headset, inside the mobile terminal, an audio data packet may be sent to a wireless transmission module, and then the wireless transmission module sends the audio data packet to a wireless receiving module of the Bluetooth® headset. The Bluetooth® headset subsequently completes procedures such as unpacking and playing.

In this embodiment, a type of a headset connected to a headset interface is determined, and a different transmission channel may be used according to the type of the headset to transmit a different type of signal; for a multi-channel headset, an audio digital signal is transmitted, and for a headset that is not a multi-channel headset, an audio analog signal is transmitted, thereby implementing an effect that a mobile terminal is compatible with different types of headsets, and cooperate with the different types of headsets to transmit different types of audio files. This can implement normally playing a multi-channel audio file, and enable a multi-channel headset end to output a multi-channel surround sound.

Figure 2:
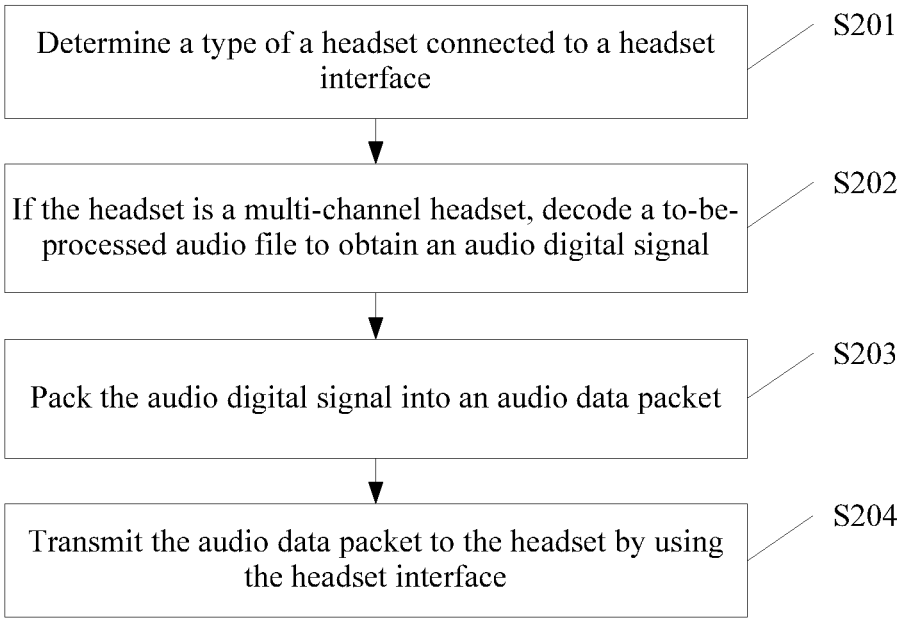
FIG. 2 is a schematic flowchart of a second embodiment of a transmission method according to the present disclosure.

Referring to FIG. 2, FIG. 2 is a schematic flowchart of a second embodiment of a transmission method according to the present disclosure. In this embodiment, the method includes the following steps.

S201. Determine a type of a headset connected to a headset interface.

More specifically, the type of the headset may be classified into a multi-channel headset, a binaural headset, and a monaural headset. When a user uses different types of headsets, data or signal transmission manners and channels are different, and therefore, when a headset is inserted into the headset interface, a type of the headset needs to be determined.

Optionally, the following manners may be used to determine the type of the headset.

When the headset is inserted into the headset interface, ground impedance of a headset pin is detected, and the type of the headset is identified according to the ground impedance; or a voltage detection point is disposed on a headset pin of the headset interface; when the headset is inserted into the headset interface, a voltage value of the voltage detection point is detected, and the type of the headset is identified according to the voltage value, where the headset pin on which the voltage detection point is disposed may be a left channel pin, a right channel pin, or a microphone pin; or headset type indication information entered by a user is received; when the headset is inserted into the headset interface, the type of the headset is determined according to the headset type indication information; or headset type indication information sent by the headset is received, and the type of the headset is determined according to the headset type indication information.

When the manner in which the ground impedance of the pin is detected is used, the detected headset pin may be the left channel pin, the right channel pin, or the microphone pin. If the manner in which the headset type indication information entered by the user is received is used to determine the type of the headset, the user may first enter the headset type indication information into a mobile terminal, and then insert the headset, so as to implement determining of the type of the headset; or the user may first insert the headset, and then a mobile terminal prompts the user to input the headset type indication information, so as to implement determining of the type of the headset.

S202. If the headset is a multi-channel headset, decode a to-be-processed audio file to obtain an audio digital signal.

Optionally, the audio file may be a file stored on a mobile terminal, or may be an online file obtained from a network, or a file being transmitted by another device to the mobile terminal.

An existing multi-channel audio file, for example, an n.1-channel audio file such as a 5.1-channel audio file and a 7.1-channel audio file can be decoded to obtain (n+1) audio digital signals, where n is greater than or equal to 3. For example, the 5.1-channel audio file is decoded to obtain six audio digital signals, and the 7.1-channel audio file is decoded to obtain eight audio digital signals.

S203. Pack the audio digital signal into an audio data packet.

Optionally, during packing, the audio digital signal may be packed into one audio data packet, and then the audio data packet is transmitted for only one time; or the audio digital signal may be packed into at least one audio data packet according to a requirement of a transmission rate or transmission bandwidth, and then the audio data packets are transmitted for corresponding times.

Optionally, before the audio digital signal is packed into an audio data packet, DOLBY sound processing may further be performed on the audio digital signal, and then an audio digital signal obtained after DOLBY sound processing is performed is packed into an audio data packet; or optionally, before the audio digital signal is packed into an audio data packet, DIGITAL THEATER SYSTEM sound processing is performed on the audio digital signal, and then an audio digital signal obtained after DIGITAL THEATER SYSTEM sound processing is performed is packed into an audio data packet.

S204. Transmit the audio data packet to the headset using the headset interface.

Optionally, the headset interface includes a left channel pin, a right channel pin, a ground pin, or a microphone pin.

The transmitting the audio data packet to the headset using the headset interface includes transmitting the audio data packet to the headset using at least one of the left channel pin and the right channel pin of the headset interface. For some multi-channel headsets that do not need the ground pin or the mobile terminal to supply power, the ground pin or the microphone pin may be used to transmit the audio data packet.

For example, when a USB is used to transmit a 5.1-channel audio file, the 5.1-channel audio file may first be decoded to obtain six audio digital signals, then the six audio digital signals are packed to obtain an audio data packet, and then the USB is used to perform transmission. Four pins of the headset interface need to be used simultaneously according to a USB transmission protocol. The ground pin of the headset interface may be used as a ground pin of the USB, the microphone pin of the headset interface may be used as a power supply pin of the USB, and the left channel pin and the right channel pin of the headset interface may be respectively used as two data transmission pins of the USB.

When another interface except the USB is used to perform transmission, a quantity of pins occupied may be different, and functions may be different. It only needs to be ensured that the quantity of pins occupied is less than or equal to 4.

Optionally, the method may further include outputting a switching instruction according to the type of the headset connected to the headset interface; if the headset is a multi-channel headset, connecting a power supply of the mobile terminal and the microphone pin of the headset interface; if the headset is not a multi-channel headset, connecting a voice processor and the microphone pin of the headset interface, where the voice processor is configured to process sound information received from the microphone pin. Therefore, the mobile terminal can supply power to the headset or normally process switching of a signal received by a microphone.

Figure 3:
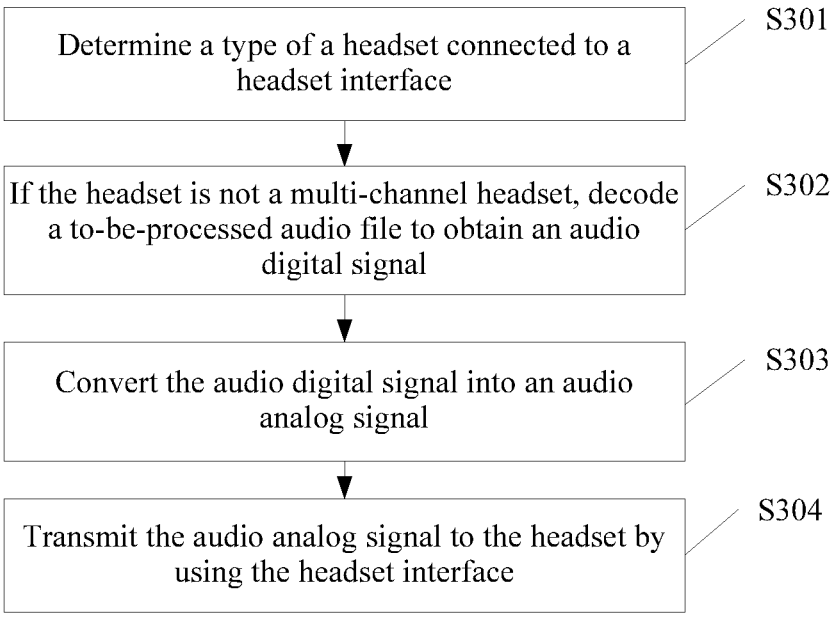
FIG. 3 is a schematic flowchart of a third embodiment of a transmission method according to the present disclosure.

Referring to FIG. 3, FIG. 3 is a schematic flowchart of a third embodiment of a transmission method according to the present disclosure. In this embodiment, the method includes the following steps.

S301. Determine a type of a headset connected to a headset interface.

S302. If the headset is not a multi-channel headset, decode a to-be-processed audio file to obtain a corresponding quantity of audio digital signals.

The to-be-processed audio file herein is a monaural audio file or a binaural audio file.

For example, a monaural audio file can be decoded to obtain one audio digital signal, a 2.0-channel audio file can be decoded to obtain two audio digital signals, and a 2.1-channel audio file can be decoded to obtain three audio digital signals. Then, corresponding digital-to-analog conversion is performed on an audio digital signal obtained by means of decoding, and an audio analog signal obtained after the corresponding digital-to-analog conversion can be transmitted using a corresponding pin in four pins of the existing headset interface.

S303. Convert the audio digital signal into an audio analog signal.

S304. Transmit the audio analog signal to the headset using the headset interface.

To match the type of the headset, division or combination may be performed on an audio analog signal obtained after digital-to-analog conversion, such that there is a sound on each channel of the headset. For example, if an audio file is a monaural audio file, and a headset is a binaural headset, one audio analog signal obtained after digital-to-analog conversion is divided into two audio analog signals, and the two audio analog signals are sent to left and right channels of the headset. If an audio file is a 2.0-channel audio file, and a headset is a monaural headset, two audio analog signals obtained after digital-to-analog conversion may be combined and then transmitted to the monaural headset. Division or combination may not be performed, for example, after a monaural audio analog signal is obtained by decoding a monaural audio file and performing digital-to-analog conversion, the monaural audio analog signal may be transmitted to only a left channel or a right channel of a binaural headset. After two audio analog signals are obtained by decoding a 2.0-channel audio file and performing digital-to-analog conversion, one of the two audio analog signals is selected to be transmitted to a monaural headset.

Figure 4:
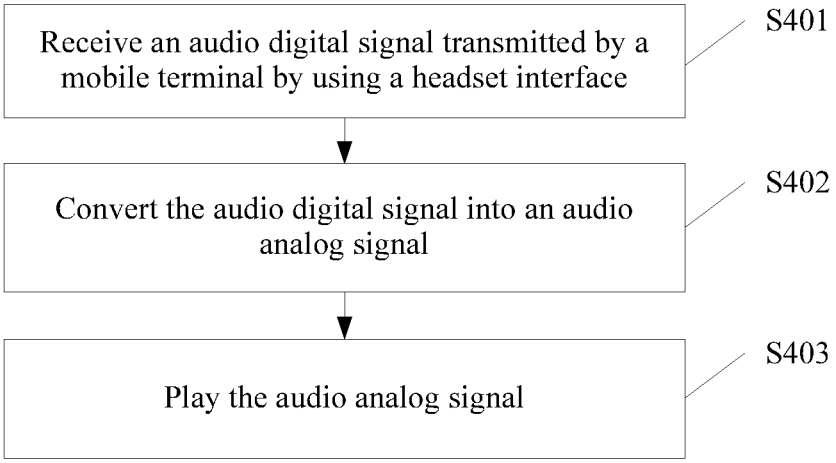
FIG. 4 is a schematic flowchart of a fourth embodiment of a transmission method according to the present disclosure.

Referring to FIG. 4, FIG. 4 is a schematic flowchart of a fourth embodiment of a transmission method according to the present disclosure. In this embodiment, the method includes the following steps.

S401. Receive an audio digital signal transmitted by a mobile terminal using the headset interface.

S402. Convert the audio digital signal into an audio analog signal.

Optionally, communication between a headset plug of a multi-channel headset and a function module responsible for unpacking may be performed using a USB or an SPDIF.

Optionally, before the audio digital signal is converted into the audio analog signal, DOLBY sound processing may be performed on the audio digital signal, and then an audio digital signal obtained after DOLBY sound processing is performed is converted into an audio analog signal; or DIGITAL THEATER SYSTEM sound processing may be performed on the audio digital signal, and then an audio digital signal obtained after DIGITAL THEATER SYSTEM sound processing is performed is converted into an audio analog signal.

Optionally, if the mobile terminal sends an audio data packet that carries the audio digital signal, the method may further include the following steps: receiving an audio data packet that carries the audio digital signal and is sent by the mobile terminal; and unpacking the audio data packet to obtain the audio digital signal, and then performing digital-to-analog conversion on the unpacked audio digital signal.

S403. Play the audio analog signal.

To match a quantity of sound channels of the headset, multiple audio analog signals may be divided or combined to obtain audio analog signals corresponding to the quantity of sound channels of the headset for playing. For example, if an audio file is a 5.1-channel audio file, and a headset is a 4-channel headset, the multi-channel headset can unpack and convert a received 5.1-channel audio data packet into six audio analog signals, combine four audio analog signals in the six audio analog signals into two audio analog signals, and respectively play the two audio analog signals and the remaining two audio analog signals using four sound channels; or if an audio file is a 5.1-channel audio file, and a headset is an 8-channel headset, the multi-channel headset can unpack and convert a received 5.1-channel audio data packet to six audio analog signals, divide two audio analog signals in the six audio analog signals into four audio analog signals, and respectively play the four audio analog signals and the remaining four audio analog signals using eight sound channels.

Optionally, when the mobile terminal plays a monaural audio file or a binaural audio file, the mobile terminal may output a monaural or binaural audio analog signal to a multi-channel headset according to a conventional playing manner, and the multi-channel headset can receive the monaural or binaural audio analog signal transmitted by the mobile terminal using the headset interface, and directly play the monaural or binaural audio analog signal.

Figure 5:
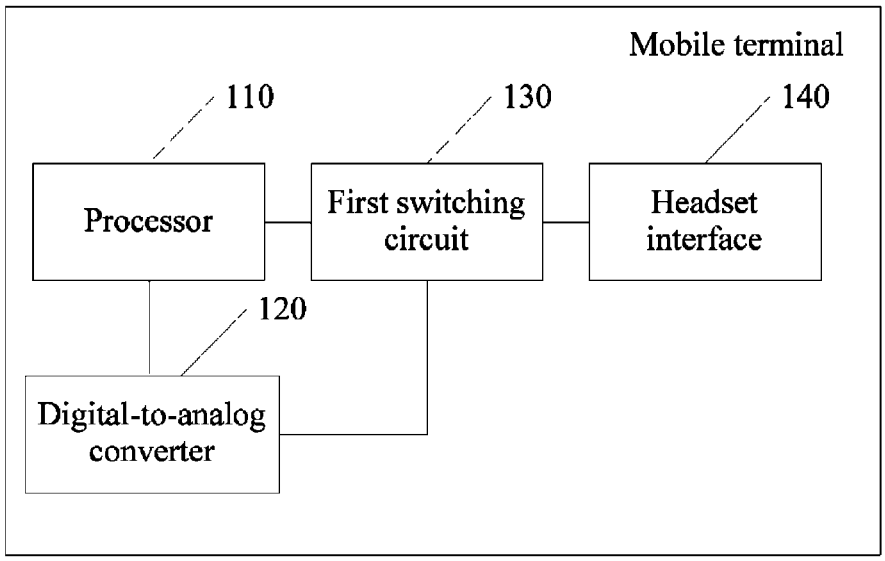
FIG. 5 is a schematic diagram of composition of a first embodiment of a mobile terminal according to the present disclosure.

Referring to FIG. 5, FIG. 5 is a schematic diagram of composition of a first embodiment of a mobile terminal according to the present disclosure. In this embodiment, the mobile terminal is provided with a headset jack, where the mobile terminal includes a processor 110, a digital-to-analog converter 120, a first switching circuit 130, and a headset interface 140, where the processor 110 is connected to the first switching circuit 130, the digital-to-analog converter 120 is connected to the first switching circuit 130, and the first switching circuit 130 is connected to the headset interface 140; the processor 110 is configured to decode an audio file to obtain an audio digital signal, determine a type of a headset connected to the headset interface, generate a first switching instruction according to the type of the headset, and transmit the first switching instruction to the first switching circuit 130; if the headset is a multi-channel headset, the first switching instruction carries indication information used to instruct the first switching circuit 130 to transmit an audio digital signal to the headset interface 140; and if the headset is not a multi-channel headset, the first switching instruction carries indication information used to instruct the first switching circuit 130 to transmit an audio analog signal to the headset interface 140; the digital-to-analog converter 120 is configured to receive an audio digital signal from the processor 110, and convert the audio digital signal into the audio analog signal; the first switching circuit 130 is configured to receive the first switching instruction, and transmit the audio digital signal or the audio analog signal to the headset interface 140 according to the first switching instruction; and the headset interface 140 is configured to transmit the audio digital signal to the headset or transmit the audio analog signal to the headset.

Optionally, the digital-to-analog converter 120 is connected to the processor 110 and the first switching circuit 130.

More specifically, the digital-to-analog converter 120 is electrically connected to the processor 110, and at the same time, is electrically connected to the first switching circuit 130; then the first switching circuit 130 is electrically connected to the headset interface 140. When the headset connected to the headset interface 140 is a multi-channel headset, in this case, an audio digital signal needs to be transmitted. The processor 110 sends the first switching instruction to the first switching circuit 130, and sends the audio digital signal obtained by means of decoding to the headset interface 140 using the first switching circuit 130. When the headset connected to the headset interface 140 is not a multi-channel headset, the processor 110 sends the first switching instruction to the first switching circuit 130 and sends the audio digital signal obtained by means of decoding to the digital-to-analog converter 120, the digital-to-analog converter 120 performs digital-to-analog conversion to obtain an audio analog signal, and then the first switching circuit 130 receives the audio analog signal from the digital-to-analog converter 120 and transmits the audio analog signal to the headset interface 140.

The first switching circuit 130 may include a control end, and the processor 110 may transmit the first switching instruction to the first switching circuit 130 through an independent instruction transmission line, so as to control and instruct a working state of the first switching circuit 130. The instruction transmission line and an audio digital signal transmission line between the processor 110 and the first switching circuit 130 may be multiplexed, provided that the processor 110 controls the first switching circuit 130, which is not limited herein.

Optionally, the processor 110 is further configured to pack the audio digital signal into an audio data packet, and directly send the audio data packet to the headset interface 140 using the first switching circuit 130; and the headset interface 140 is configured to transmit the audio data packet to the headset.

Correspondingly, on a headset side, the obtained audio data packet can be played as long as unpacking and digital-to-analog conversion are performed on the obtained audio data packet.

A to-be-processed audio file may be a 4.1-channel audio file, a 5.1-channel audio file, a 6.1-channel audio file, a 7.1-channel audio file, or an audio file of more channels that may emerge subsequently, which is not limited herein.

A headset interface of an existing mobile terminal such as a mobile phone or a tablet computer has a maximum of four pins, that is, a left channel pin, a right channel pin, a ground pin, and a microphone pin, where the ground pin is generally configured to perform grounding, but is not configured to transmit data. Therefore, if transmission is performed according to a conventional multi-channel audio transmission manner, that is, each pin transmits one audio signal, the four pins of the headset interface cannot directly transmit multiple audio digital signals obtained by decoding a multi-channel audio file. For example, there are six independent audio signals obtained by decoding a 5.1-channel audio file, and the four pins cannot meet transmission requirements. Therefore, an additional switching circuit may be disposed in the mobile terminal, or the headset interface of the mobile terminal may be directly transformed. The switching circuit and a circuit of the headset interface are integrated, and then an audio transmission channel is switched to a channel on which the switching circuit is corresponding to a data interface and the headset interface, where a transmitted signal is an audio digital signal. Multiple audio digital signals may be transmitted after being packed.

Optionally, when an audio data packet is being transmitted to a headset interface, transmission may be performed using a USB or an SPDIF. Another available interface may be used, and the present disclosure does not set any limitation thereto.

For example, when the USB is used to transmit a 5.1-channel audio file, the 5.1-channel audio file may be first decoded to obtain six audio digital signals, and then the six audio digital signals are packed to obtain an audio data packet. Optionally, a packing quantity may be one or more, and then the USB is used to perform transmission. Two data transmission pins, one ground pin, and one power supply pin need to be used simultaneously according to a USB transmission protocol. Therefore, four pins of a headset interface need to be occupied simultaneously. When transmission is performed using another interface, a quantity of pins occupied may be different, and it only needs to be ensured that the quantity of pins occupied is less than or equal to 4; then the audio data packet is transmitted to a headset using the headset interface. If the packing quantity is greater than 1, a transmission channel keeps unchanged to perform continuous transmission for multiple times. In this way, a purpose of transmitting a data packet, obtained by decoding and packing a multi-channel audio file, to a headset side is implemented.

Optionally, the processor 110 is further configured to, after obtaining the audio digital signal by means of decoding and before packing the audio digital signal into the audio data packet, perform DOLBY sound processing or DIGITAL THEATER SYSTEM sound processing on the audio digital signal.

Optionally, the first switching circuit 130 is configured to transmit the audio digital signal or the audio analog signal, or the audio data packet obtained by packing the audio digital signal, to a sound channel pin of the headset interface.

The headset interface 140 may include a left channel pin, a right channel pin, a ground pin, or a microphone pin.

The headset interface 140 is configured to transmit the audio digital signal or the audio analog signal or the audio data packet obtained by packing the audio digital signal, to the headset using at least one of the left channel pin or the right channel pin.

For example, when a 5.1-channel audio file is being played, multiple audio digital signals obtained by means of decoding may be packed and transmitted to the headset using the left channel pin and the right channel pin of the headset interface 140; when a 2.0-channel audio file is being played, two audio digital signals obtained by means of decoding may be converted into audio analog signals, and the audio analog signals are transmitted to the headset using the left channel pin and the right channel pin of the headset interface 140; when a monaural audio file is being played, one audio digital signal obtained by means of decoding may be converted into an audio analog signal, and the audio analog signal is transmitted to the headset using the left channel pin or the right channel pin of the headset interface 140.

The microphone pin may be configured to transmit the audio digital signal, or the audio analog signal, or the audio data packet; a process is similar and is not described herein again.

Figure 6:
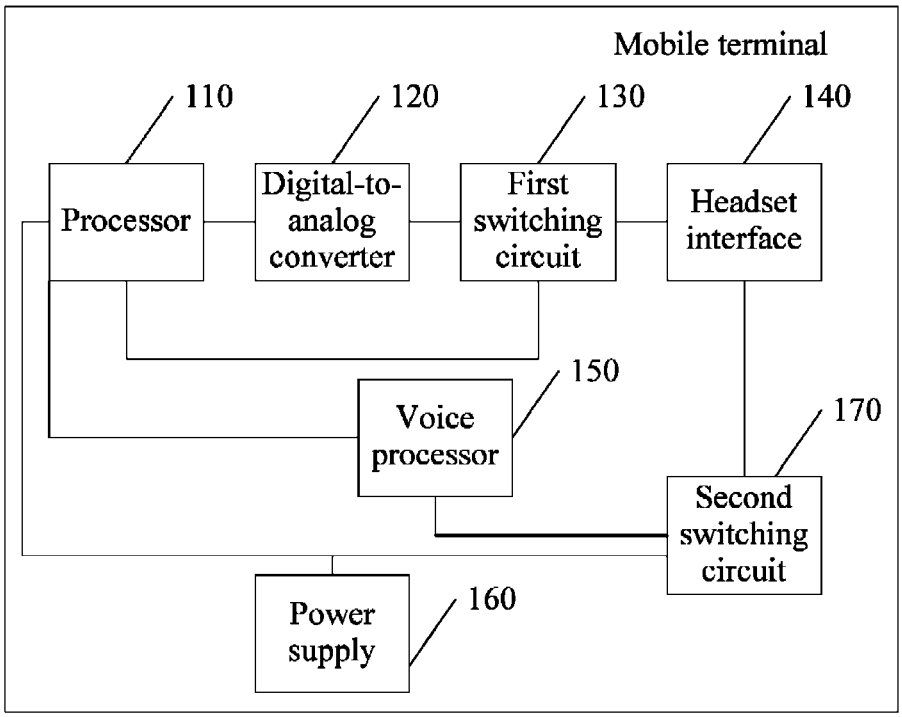
FIG. 6 is a schematic diagram of composition of a second embodiment of a mobile terminal according to the present disclosure.

Optionally, as shown in FIG. 6, in a second embodiment of a mobile terminal according to the present disclosure, the mobile terminal further includes a voice processor 150, a power supply 160, and a second switching circuit 170, where the voice processor 150 is configured to process sound information received from the microphone pin of the headset interface; the processor 110 is further configured to output a second switching instruction to the second switching circuit 170 according to the type of the headset connected to the headset interface 140; if the headset is a multi-channel headset, the second switching instruction instructs the second switching circuit 170 to connect the power supply and the microphone pin of the headset interface 140; and if the headset is not a multi-channel headset, the second switching instruction instructs the second switching circuit 170 to connect the voice processor 150 and the microphone pin of the headset interface 140; and the second switching circuit 170 is connected to the microphone pin of the headset interface 140, and is configured to receive the second switching instruction, and switch the microphone pin of the headset interface 140 according to the second switching instruction, such that the microphone pin of the headset interface 140 is connected to the voice processor 150 or the power supply 160.

The first switching circuit 130 and the second switching circuit 170 may be combined into a logical interface circuit, where the logical interface circuit may communicate with the processor 110 using a USB or using an SPDIF. That is, the logical interface circuit may include a line interface of the USB or the SPDIF.

For different types of headset interfaces, the processor 110 may determine a type of a headset connected to the headset interface 140 according to different manners.

When the headset is inserted into the headset interface, ground impedance of a headset pin is detected, and the type of the headset is identified according to the ground impedance; or a voltage detection point is disposed on a headset pin of the headset interface; when the headset is inserted into the headset interface, a voltage value of the voltage detection point is detected, and the type of the headset is identified according to the voltage value, where the headset pin on which the voltage detection point is disposed may be a left channel pin, a right channel pin, or a microphone pin; or headset type indication information entered by a user is received; when the headset is inserted into the headset interface, the type of the headset is determined according to the headset type indication information; or headset type indication information sent by the headset is received, and the type of the headset is determined according to the headset type indication information.

When the manner in which the ground impedance of the pin is detected is used, the detected headset pin may be the left channel pin, the right channel pin, or the microphone pin. If the manner in which the headset type indication information entered by the user is received is used to determine the type of the headset, the user may first enter the headset type indication information into the mobile terminal, and then insert the headset, so as to implement determining of the type of the headset; or the user may first insert the headset, and then the mobile terminal prompts the user to input the headset type indication information, so as to implement determining of the type of the headset.

Optionally, the headset interface 140 is a wired connection interface; and the mobile terminal further includes a headset identification circuit, where the headset identification circuit is connected to the processor 110 and the headset interface 140, and is configured to, when the headset is inserted into the headset interface 140, detect the ground impedance of the pin of the headset interface 140 or the voltage value of the voltage detection point disposed on the headset pin; and the processor 110 is further configured to identify the type of the headset according to the ground impedance or the voltage value; or the headset interface 140 is a wireless connection interface; and the processor 110 is further configured to receive the headset type indication information sent by the headset, and determine the type of the headset according to the headset type indication information.

The mobile terminal further includes an input interface configured to receive the headset type indication information entered by the user; and the processor 110 is further configured to acquire the headset type indication information, and determine the type of the headset according to the headset type indication information, where, after identifying the type of the headset interface and sending the first switching instruction, the processor 110 decodes the audio file to obtain the audio digital signal.

Figure 12:
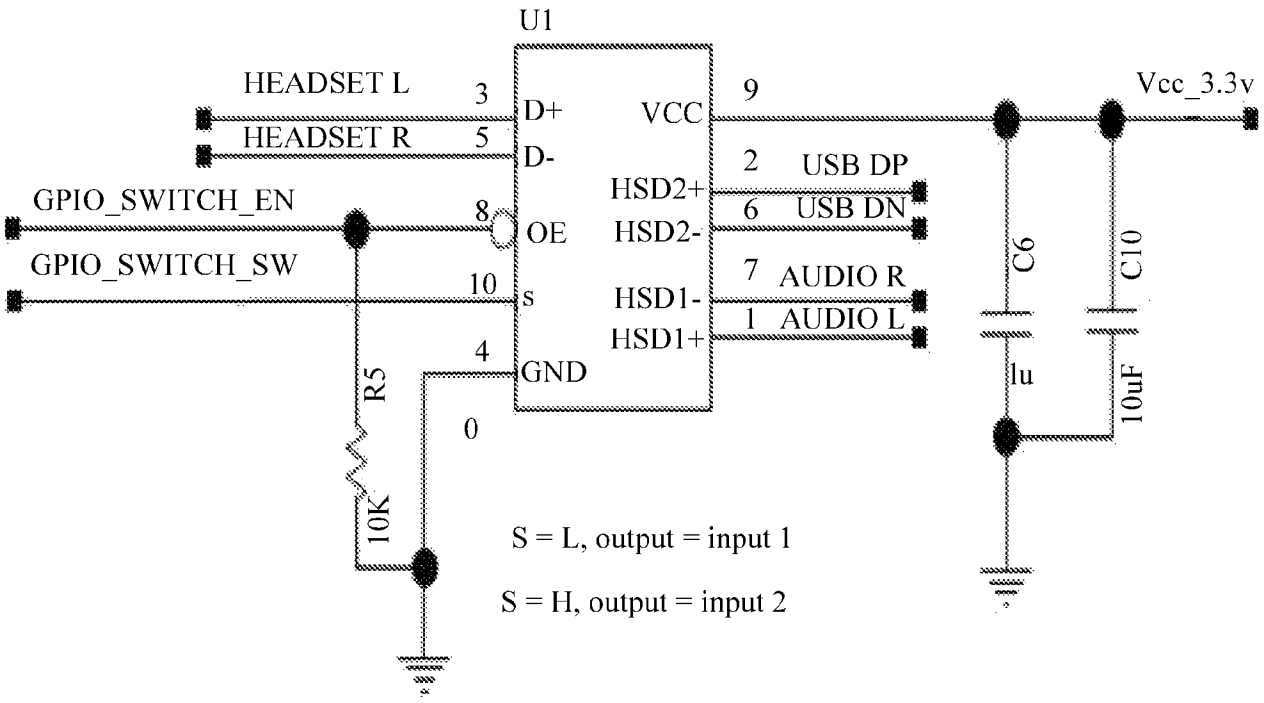
FIG. 12 is a schematic circuit diagram of a first switching circuit of a mobile terminal according to the present disclosure.

Optionally, the headset interface is a 3.5 mm/2.5 mm headset jack, which includes a left channel pin, a right channel pin, a ground pin, and a microphone pin. Referring to FIG. 12, FIG. 12 is a schematic circuit diagram of a first switching circuit of a mobile terminal according to the present disclosure. The first switching circuit 130 includes an analog switch, where a power input pin of the analog switch is connected to a working voltage, a ground pin of the analog switch is grounded, and a switching control pin of the analog switch is connected to a first signal output pin of the processor of the mobile terminal and is configured to receive the first switching instruction output by the processor; an output end of a first data output pin of the analog switch is connected to the left channel pin of the headset interface of the mobile terminal, and an output end of a second data output pin of the analog switch is connected to the right channel pin of the headset interface of the mobile terminal; and the analog switch further includes a first data input pin, a second data input pin, a third data input pin, and a fourth data input pin, where an input end of the first data input pin and an input end of the second data input pin are configured to receive the audio digital signal or the audio data packet, and input ends of the third data input pin and the fourth data input pin are configured to receive the audio analog signal, where if an audio digital signal or an audio data packet needs to be output, an input end of the first data output pin and an input end of the second data output pin are respectively connected to an output end of the first data input pin and an output end of the second data input pin, and if an audio analog signal needs to be output, the input end of the first data output pin and the input end of the second data output pin are respectively connected to an output end of the third data input pin and an output end of the fourth data input pin.

Figure 13:
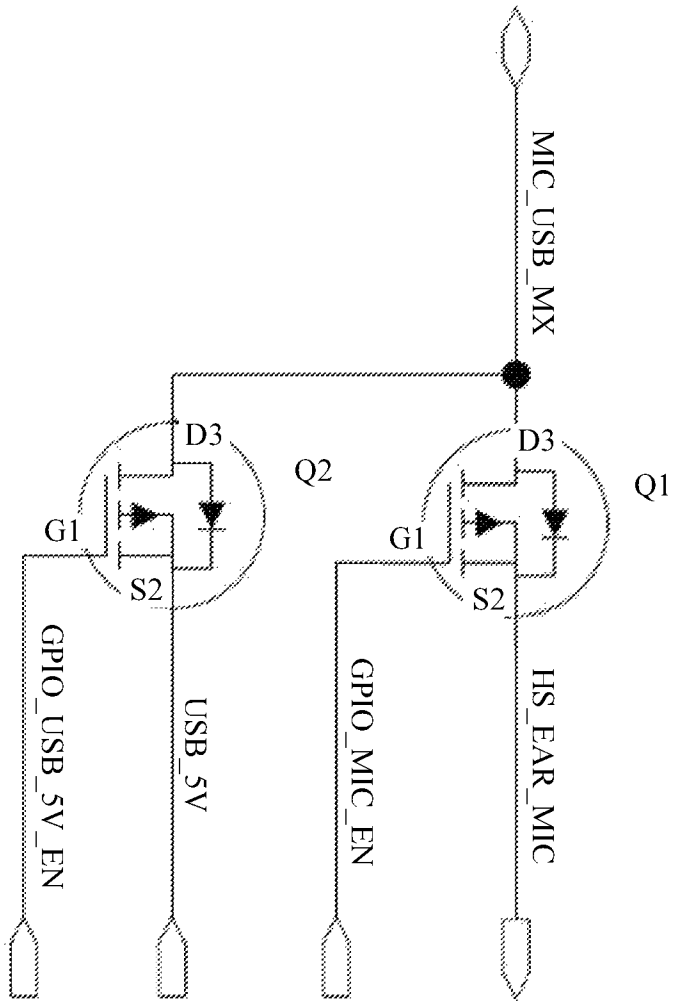
FIG. 13 is a schematic circuit diagram of a second switching circuit of a mobile terminal according to the present disclosure.

Optionally, the headset interface is a 3.5 mm/2.5 mm headset jack. Referring to FIG. 13, FIG. 13 is a schematic circuit diagram of a second switching circuit of a mobile terminal according to the present disclosure. The second switching circuit includes a first PMOS transistor and a second PMOS transistor, where a gate of the first PMOS transistor is connected to the microphone pin of the headset interface of the mobile terminal, a source of the first PMOS transistor is connected to the voice processor, and a drain of the first PMOS transistor is connected to a second signal output pin of the processor of the mobile terminal, where the second signal output pin is configured to output a level signal, so as to control on or off of the first PMOS transistor; a gate of the second PMOS transistor is connected to the microphone pin of the headset interface of the mobile terminal, a source of the second PMOS transistor is connected to the power supply, and a drain of the second PMOS transistor is connected to a third signal output pin of the processor of the mobile terminal, where the third signal output pin is configured to output a level signal, so as to control on or off of the second PMOS transistor.

It should be noted that in terms of functions, the processor of the foregoing mobile terminal may be divided into a decoding module, an identification module, and a control module, and a sound processing module and a packing module may further be included, where the decoding module is configured to decode an audio file to obtain an audio digital signal, the identification module is configured to identify a type of a headset connected to the headset interface, and the control module is configured to generate a first switching instruction according to the type of the headset, and transmit the first switching instruction to the first switching circuit, so as to control a working state of the first switching circuit; if the headset is a multi-channel headset, the first switching instruction carries indication information used to instruct the first switching circuit to transmit an audio digital signal to the headset interface; if the headset is not a multi-channel headset, the first switching instruction carries indication information used to instruct the first switching circuit to transmit an audio analog signal to the headset interface; the sound processor is configured to, after the audio digital signal is obtained by means of decoding and before the audio digital signal is packed into the audio data packet, perform DOLBY sound processing or DIGITAL THEATER SYSTEM sound processing on the audio digital signal; and the packing module is configured to pack the audio digital signal.

In hardware implementation, the decoding module, the identification module, the control module, and the sound processing module may be integrated, or may exist independently; the digital-to-analog converter may be integrated with the processor or may be disposed independently.

Figure 7:
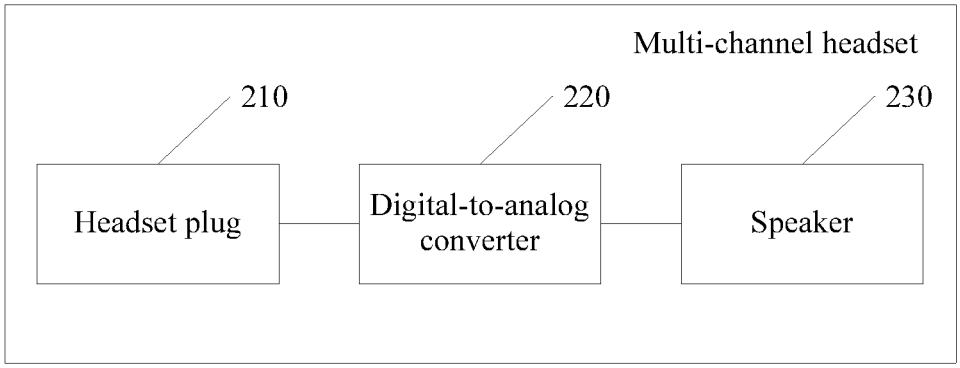
FIG. 7 is a schematic diagram of composition of a first embodiment of a multi-channel headset according to the present disclosure.

Referring to FIG. 7, FIG. 7 is a schematic diagram of composition of a first embodiment of a multi-channel headset according to the present disclosure. In this embodiment, the multi-channel headset includes a headset plug 210, a digital-to-analog converter 220, and a speaker 230, where the digital-to-analog converter 220 is connected to the speaker 230; the headset plug 210 is configured to receive an audio digital signal transmitted by a mobile terminal using the headset interface; the digital-to-analog converter 220 is configured to convert the audio digital signal into an audio analog signal; and the speaker 230 is configured to play the audio analog signal.

Figure 8:
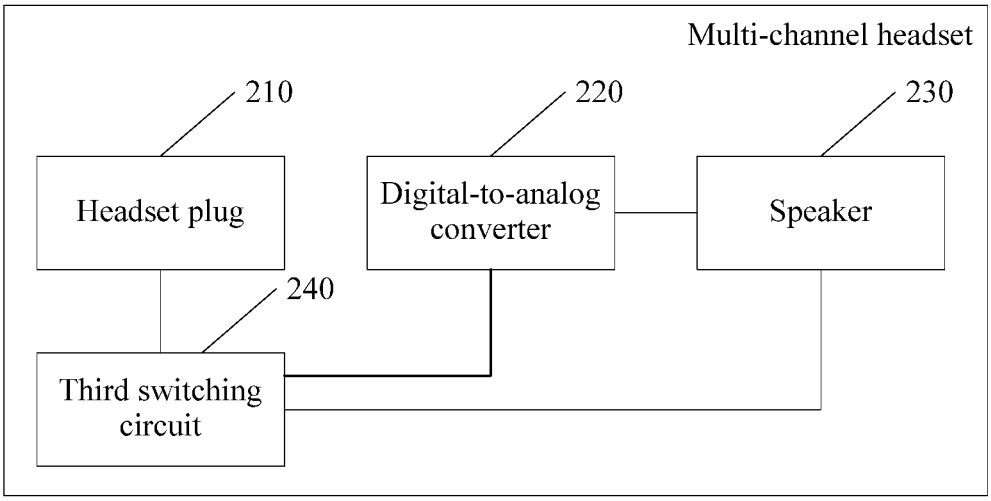
FIG. 8 is a schematic diagram of composition of a second embodiment of a multi-channel headset according to the present disclosure.

Optionally, in an embodiment shown in FIG. 8, the multi-channel headset further includes a third switching circuit 240, where the third switching circuit 240 is connected to the headset plug 210; the headset plug 210 is further configured to receive an audio analog signal sent by the mobile terminal using the headset interface; and the third switching circuit 240 is configured to connect the headset plug 210 and the speaker 230, and send the audio analog signal to the speaker 230; or connect the headset plug 210 and the digital-to-analog converter 220, and send the audio digital signal to the digital-to-analog converter 220.

The third switching circuit 240 may receive an instruction from the mobile terminal, so as to switch a working state (that is, transmission data type).

More specifically, when the mobile terminal determines that a headset connected to the headset interface is a multi-channel headset, the mobile terminal sends a first switching instruction to control a first switching circuit, and when the mobile terminal sends the first switching instruction or within a specific time after the mobile terminal sends the first switching instruction, the mobile terminal sends a third switching instruction to the third switching circuit 240, so as to control a working state of the third switching circuit 240. The third switching circuit 240 may determine by itself a data type received by the headset plug 210, where the data type may be an audio digital signal, an audio analog signal, or an audio data packet.

In addition, a physical switch may also be disposed on the multi-channel headset to switch the working state of the third switching circuit 240, which is not limited herein.

Figure 9:
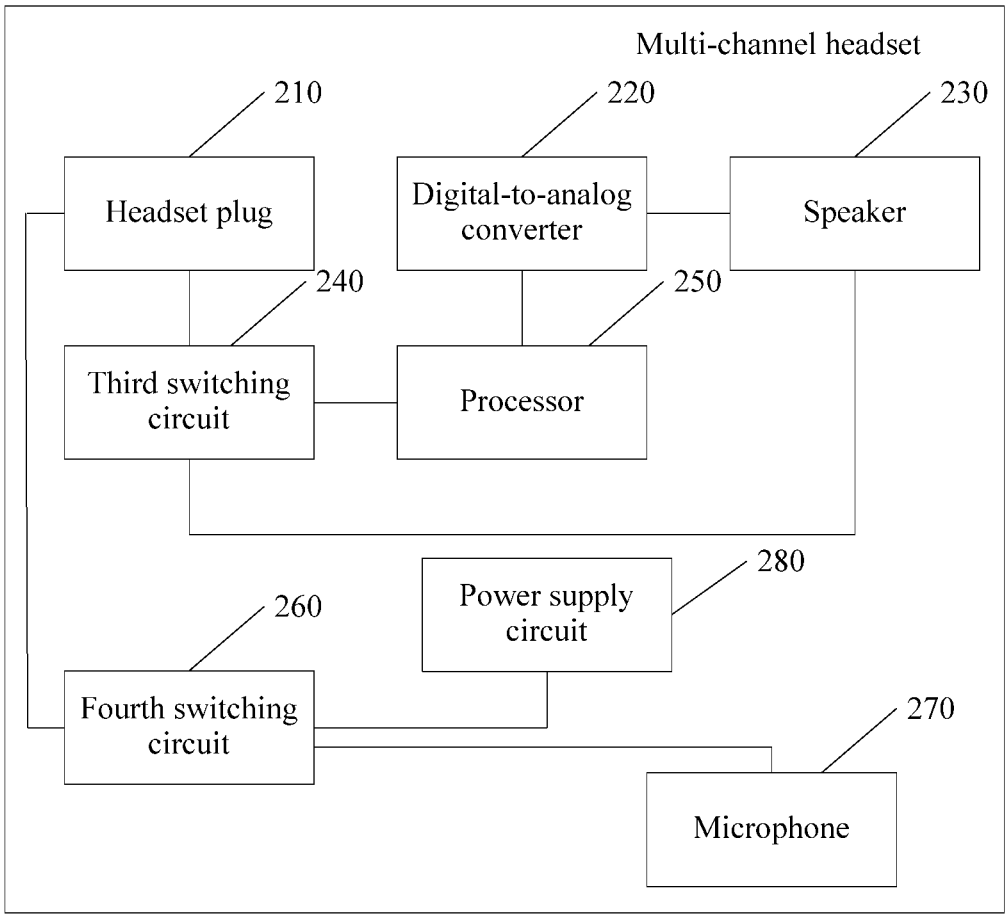
FIG. 9 is a schematic diagram of composition of a third embodiment of a multi-channel headset according to the present disclosure.

Optionally, in an embodiment shown in FIG. 9, the multi-channel headset may further include a processor 250, where the processor 250 is connected between the third switching circuit 240 and the digital-to-analog converter 220; the headset plug 210 is configured to receive an audio data packet that carries the audio digital signal and is sent by the mobile terminal; the processor 250 is configured to unpack the audio data packet to obtain the audio digital signal, and send the audio digital signal to the digital-to-analog converter 220; and the processor 250 is further configured to, before sending the audio digital signal to the digital-to-analog converter 220, perform DOLBY sound processing or DIGITAL THEATER SYSTEM sound processing on the audio digital signal, and send an audio digital signal obtained after DOLBY sound processing or DIGITAL THEATER SYSTEM sound processing is performed to the digital-to-analog converter 220.

In this way, some mobile terminals that are of relatively poor performance and cannot perform sound processing can still make a user experience a multi-channel effect of a multi-channel audio file.

Optionally, the multi-channel headset further includes a fourth switching circuit 260, a microphone 270, and a power supply circuit 280, where the fourth switching circuit 260 is connected to the headset interface, and is configured to connect a microphone pin of the headset interface and the microphone 270 or the power supply circuit 280; the microphone 270 is configured to receive sound information; and the power supply circuit 280 is configured to transmit electric quantity to the multi-channel headset; or the multi-channel headset further includes a power supply circuit and a power supply, where the power supply circuit is connected to the power supply, and is configured to transmit electric quantity to the multi-channel headset. The power supply circuit may be a supply line or may be a circuit formed by an electrical component such as a resistor, and can implement voltage division or voltage boosting.

The power supply is configured to provide electric energy.

The multi-channel headset may include a power management module, where the power management module is connected to the power supply circuit and is configured to receive electric energy of the power supply and supply power to an electrical component of the multi-channel headset, such as the speaker. A rechargeable battery may be built into the multi-channel headset to supply power to the multi-channel headset, and the power management module receives the electric energy of the power supply using the power supply circuit and manages charging and discharging of the chargeable battery. An external power supply such as a power supply in the mobile terminal may be used to supply power to the multi-channel headset, and the power management module only needs to connect to the power supply in the mobile terminal using the power supply circuit.

Optionally, the third switching circuit 240 and the fourth switching circuit 260 may be combined into a logical interface circuit, where the logical interface circuit may communicate with the processor using a USB or using an SPDIF.

The third switching circuit 240 may directly connect the headset plug 210 and the speaker 230 of the multi-channel headset by default, and is configured to transmit an audio analog signal.

When a headset is inserted into the mobile terminal, the third switching circuit 240 switches a transmission line between the headset plug 210 and the speaker 230 according to an instruction of the mobile terminal or according to determining of the mobile terminal itself, such that the processor and the digital-to-analog converter process an audio digital signal or an audio data packet.

The headset plug 210 is configured to receive an audio analog signal or audio digital signal or audio data packet transmitted by the mobile terminal using the headset interface.

The speaker 230 is configured to play the audio analog signal.

By adding the third switching circuit, when the mobile terminal plays a multi-channel audio file, an audio data packet received by the headset plug 210 is transmitted to the processor 250 and the digital-to-analog converter 220 for processing, and then is sent to the speaker 230 for playing. When the mobile terminal plays a monaural or binaural audio file, a monaural or binaural audio analog signal received by the headset plug 210 is directly transmitted to the speaker 230 for playing, thereby implementing that the multi-channel headset is compatible with a monaural or binaural audio file played by the mobile terminal.

It should be noted that in terms of functions, the processor of the foregoing headset may be divided into an unpacking module, and may further include a sound processing module, where the unpacking module and the sound processing module may be integrated or may exist independently in terms of hardware. For example, the unpacking module may exist as an independent micro control unit (MCU), and is configured to perform unpacking. The sound processing module exists as an independent digital signal processor (DSP), and is configured to perform multi-channel sound processing such as DOLBY effect. The digital-to-analog converter may be integrated with the processor or may be disposed independently.

Figure 10:
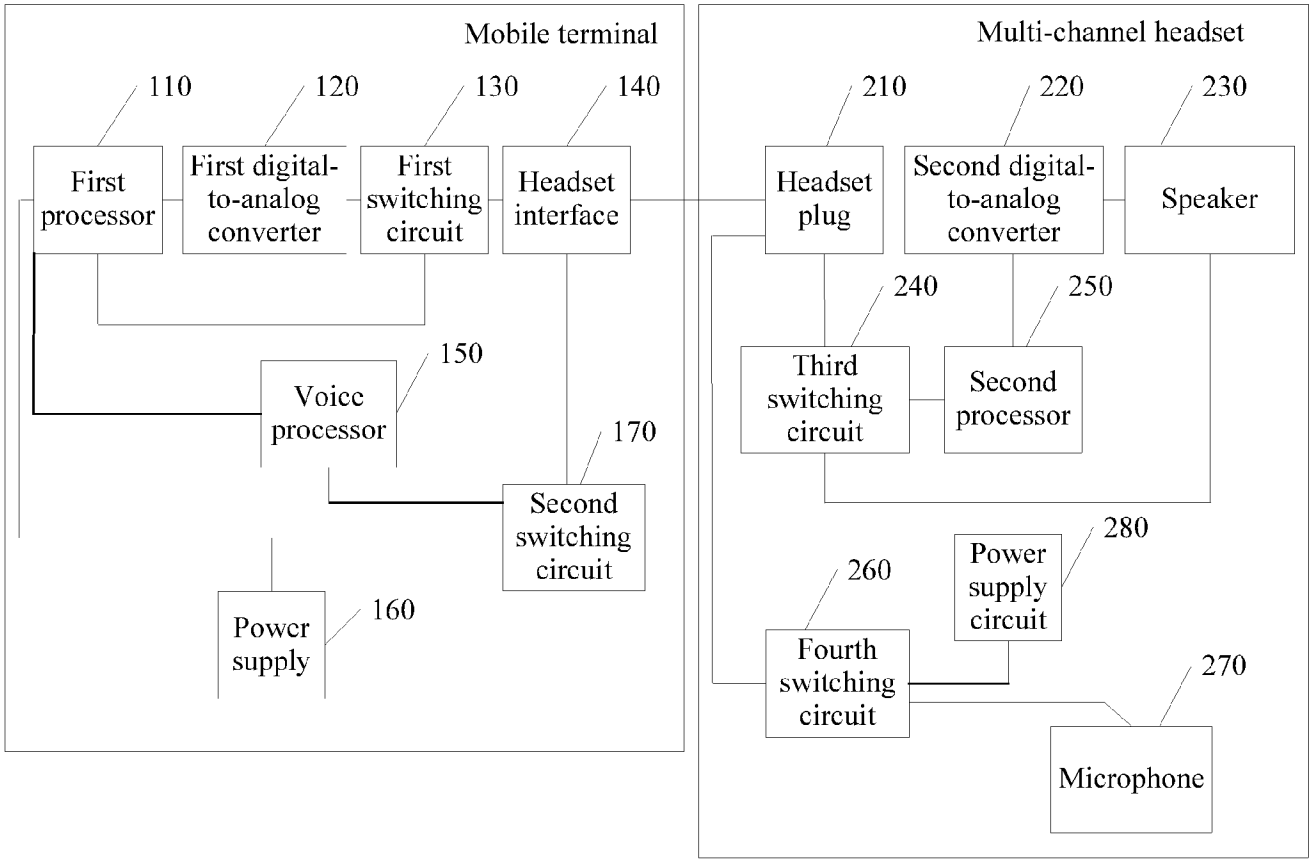
FIG. 10 is a schematic diagram of composition of an audio play system according to an embodiment of the present disclosure.

Referring to FIG. 10, FIG. 10 is a schematic diagram of composition of an audio play system according to an embodiment of the present disclosure. In this embodiment, the system includes a first processor 110, a first digital-to-analog converter 120, a first switching circuit 130, and a headset interface 140, where the first switching circuit 130 is connected to the headset interface 140; the first processor 110 is configured to decode an audio file to obtain an audio digital signal, determine a type of a headset connected to the headset interface 140, generate a first switching instruction according to the type of the headset, and transmit the first switching instruction to the first switching circuit 130; if the headset is a multi-channel headset, the first switching instruction carries indication information used to instruct the first switching circuit 130 to transmit an audio digital signal to the headset interface 140; and if the headset is not a multi-channel headset, the first switching instruction carries indication information used to instruct the first switching circuit 130 to transmit an audio analog signal to the headset interface 140; the first digital-to-analog converter 120 is configured to receive an audio digital signal from the first processor 110, and convert the audio digital signal into a first audio analog signal; the first switching circuit 130 is configured to receive the first switching instruction, and transmit the audio digital signal or the first audio analog signal to the headset interface 140 according to the first switching instruction; and the headset interface 140 is configured to transmit the audio digital signal to the headset or transmit the first audio analog signal to the headset.

The multi-channel headset includes a headset plug 210, a second digital-to-analog converter 220, and a speaker 230, where the second digital-to-analog converter 220 is connected to the speaker 230; the headset plug 210 is configured to receive an audio digital signal transmitted by the mobile terminal using the headset interface 140; the second digital-to-analog converter 220 is configured to convert the audio digital signal into a second audio analog signal; and the speaker 230 is configured to play the second audio analog signal.

Optionally, the first digital-to-analog converter 120 is connected to the first processor 110 and the first switching circuit 130.

The multi-channel headset further includes a third switching circuit 240, where the third switching circuit 240 is connected to the headset plug 210; the headset plug 210 is further configured to receive an audio analog signal sent by the mobile terminal using the headset interface 140; and the third switching circuit 240 is configured to connect the headset plug 210 and the speaker 230, and send the first audio analog signal to the speaker 230; or connect the headset plug 210 and the second digital-to-analog converter 220, and send the audio digital signal to the second digital-to-analog converter 220.

Optionally, the first processor 110 is further configured to pack the audio digital signal into an audio data packet; and directly send the audio data packet to the headset interface 140 using the first switching circuit 130; and the headset interface 140 is configured to transmit the audio data packet to the multi-channel headset.

The multi-channel headset further includes a second processor 250, where the second processor 250 is connected between the third switching circuit 240 and the second digital-to-analog converter 220; the headset plug 210 is configured to receive an audio data packet that carries the audio digital signal and is sent by the mobile terminal; and the second processor 250 is configured to unpack the audio data packet to obtain the audio digital signal, and send the audio digital signal to the second digital-to-analog converter 220.

Optionally, the first processor 110 is further configured to, after obtaining the audio digital signal by means of decoding and before packing the audio digital signal into the audio data packet, perform DOLBY sound processing or DIGITAL THEATER SYSTEM sound processing on the audio digital signal; or the second processor 250 is further configured to, before sending the audio digital signal to the second digital-to-analog converter 220, perform DOLBY sound processing or DIGITAL THEATER SYSTEM sound processing on the audio digital signal, and send an audio digital signal obtained after DOLBY sound processing or DIGITAL THEATER SYSTEM sound processing is performed to the second digital-to-analog converter 220.

Optionally, the first switching circuit 130 is configured to transmit the audio digital signal or the audio analog signal to a sound channel pin of the headset interface 140.

Optionally, the mobile terminal further includes a voice processor 150, a power supply 160, and a second switching circuit 170, where the first processor 110 is further configured to output a second switching instruction to the second switching circuit 170 according to the type of the headset connected to the headset interface 140; if the headset is a multi-channel headset, the second switching instruction instructs the second switching circuit 170 to connect the power supply 160 and a microphone pin of the headset interface 140; and if the headset is not a multi-channel headset, the second switching instruction instructs the second switching circuit 170 to connect the voice processor 150 and the microphone pin of the headset interface 140; and the second switching circuit 170 is connected to the microphone pin of the headset interface 140, and is configured to receive the second switching instruction and switch the microphone pin of the headset interface 140 according to the second switching instruction, such that the microphone pin of the headset interface 140 is connected to the voice processor 150 or the power supply 160.

The multi-channel headset further includes a fourth switching circuit 260, a microphone 270, and a power supply circuit 280, where the fourth switching circuit 260 is connected to the headset plug 210, and is configured to connect a microphone pin of the headset plug 210 and the microphone 270 or the power supply circuit 280; the microphone 270 is configured to receive sound information; and the power supply circuit 280 is configured to transmit electric quantity to the multi-channel headset; or the multi-channel headset further includes a power supply circuit and a power supply, where the power supply circuit is connected to the power supply, and is configured to transmit electric quantity to the multi-channel headset; and the power supply is configured to provide electric energy.

The headset interface 140 is a wired connection interface.

The mobile terminal further includes a headset identification circuit, where the headset identification circuit is connected to the first processor 110, and is configured to, when the headset is inserted into the headset interface 140, detect ground impedance of a pin of the headset interface 140 or a voltage value of a voltage detection point disposed on a headset pin; and the first processor 110 is further configured to identify, according to the ground impedance or the voltage value, the type of the headset inserted into the headset interface 140; or the headset interface 140 is a wireless connection interface; and the first processor 110 is further configured to receive headset type indication information sent by the headset connected to the headset interface 140, and determine the type of the headset according to the headset type indication information; or the mobile terminal further includes an input interface configured to receive headset type indication information entered by a user; and the first processor 110 is further configured to acquire the headset type indication information, and determine, according to the headset type indication information, the type of the headset connected to the headset interface 140.

After identifying the type of the headset interface and sending the first switching instruction, the first processor 110 decodes the audio file to obtain the audio digital signal.

The headset interface 140 is a 3.5 mm/2.5 mm headset jack, where the headset jack includes a left channel pin and a right channel pin, and the first switching circuit 130 may include an analog switch, where a power input pin of the analog switch is connected to a working voltage, a ground pin of the analog switch is grounded, and a switching control pin of the analog switch is connected to a first signal output pin of the first processor 110 of the mobile terminal and is configured to receive the first switching instruction output by the first processor 110; an output end of a first data output pin of the analog switch is connected to the left channel pin of the headset interface 140 of the mobile terminal, and an output end of a second data output pin of the analog switch is connected to the right channel pin of the headset interface 140 of the mobile terminal; and the analog switch further includes a first data input pin, a second data input pin, a third data input pin, and a fourth data input pin, where an input end of the first data input pin and an input end of the second data input pin are configured to receive the audio digital signal or the audio data packet, and input ends of the third data input pin and the fourth data input pin are configured to receive the audio analog signal, where if an audio digital signal or an audio data packet needs to be output, an input end of the first data output pin and an input end of the second data output pin are respectively connected to an output end of the first data input pin and an output end of the second data input pin, and if an audio analog signal needs to be output, the input end of the first data output pin and the input end of the second data output pin are respectively connected to an output end of the third data input pin and an output end of the fourth data input pin.

The headset interface 140 is a 3.5 mm/2.5 mm headset jack, and the second switching circuit 170 may include a first PMOS transistor and a second PMOS transistor, where a gate of the first PMOS transistor is connected to the microphone pin of the headset interface 140 of the mobile terminal, a source of the first PMOS transistor is connected to the voice processor 150, and a drain of the first PMOS transistor is connected to a second signal output pin of the first processor 110 of the mobile terminal, where the second signal output pin is configured to output a level signal, so as to control on or off of the first PMOS transistor; a gate of the second PMOS transistor is connected to the microphone pin of the headset interface 140 of the mobile terminal, a source of the second PMOS transistor is connected to the power supply 160, and a drain of the second PMOS transistor is connected to a third signal output pin of the first processor 110 of the mobile terminal, where the third signal output pin is configured to output a level signal, so as to control on or off of the second PMOS transistor.

When the multi-channel headset is inserted into the headset interface 140, the first processor 110 determines, according to the headset type indication information entered by the user or the detected ground impedance or voltage value of the headset pin, that the inserted headset is a multi-channel headset; the mobile terminal sends the first switching instruction to instruct the first switching circuit 130 to switch a transmission channel; the first processor 110 decodes and packs an audio file to obtain an audio data packet, and transmits the audio data packet to the headset interface 140 using a USB or an SPDIF; the headset interface 140 transmits the audio data packet to the headset plug 210; then the headset plug 210 sends the audio data packet to the second processor 250 of the multi-channel headset, and the second processor 250 unpacks the audio data packet to obtain multiple audio digital signals; then the second processor 250 performs sound processing on the audio digital signals and outputs audio digital signals obtained after sound processing to the second digital-to-analog converter 220 of the multi-channel headset; the second digital-to-analog converter 220 performs digital-to-analog conversion to obtain audio analog signals; and the speaker 230 plays the obtained audio analog signals. If the first processor 110 of the mobile terminal has a sound processing function, the first processor 110 may perform sound processing on a decoded audio file and then pack and transmit the processed audio file; the second processor 250 may directly output audio digital signals obtained after unpacking to the second digital-to-analog converter 220 of the multi-channel headset.

However, when the inserted headset is not a multi-channel headset, an audio digital signal obtained by the first processor 110 by means of decoding may be directly output to the first digital-to-analog converter 120 in the mobile terminal, and the first digital-to-analog converter 120 performs digital-to-analog conversion to obtain an audio analog signal and sends the audio analog signal to a common headset for playing.

The foregoing sound processing process may be performed in the mobile terminal, or may be performed in the multi-channel headset.

It should be noted that the power supply herein may be a 5 volt (V) power supply of a USB, or may be a power supply of another line interface.

Figure 11:
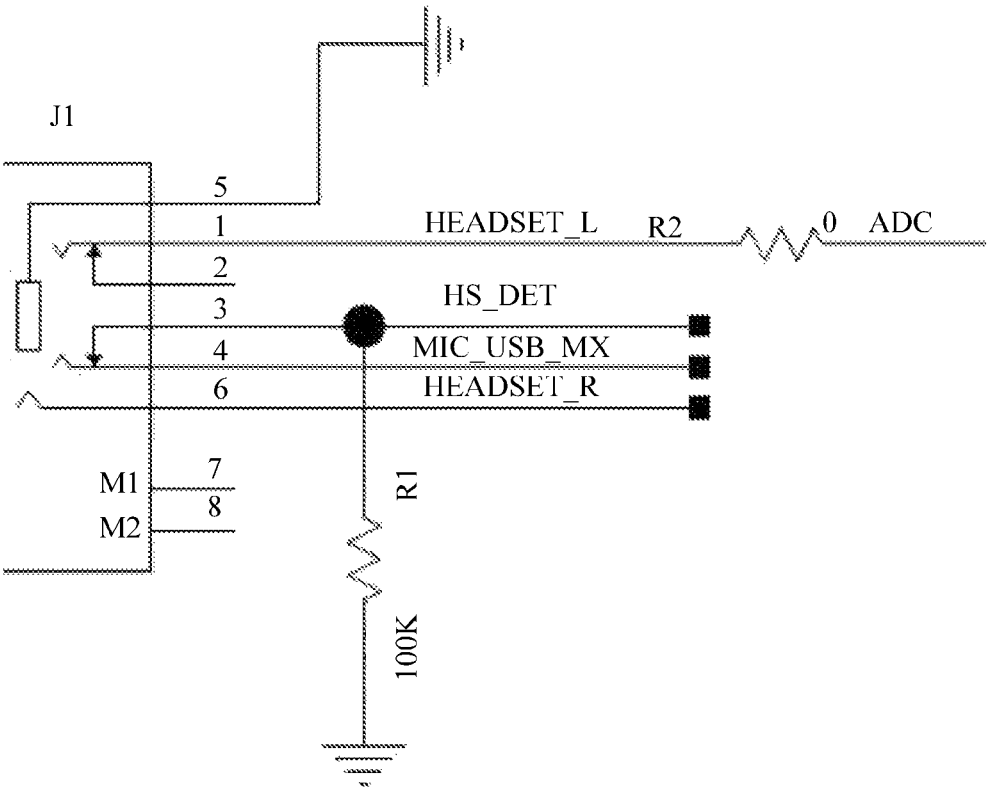
FIG. 11 is a schematic circuit diagram of a headset interface of a mobile terminal according to an embodiment of the present disclosure.

Refer to FIG. 11, FIG. 12, and FIG. 13, where FIG. 11 is a schematic circuit diagram of a headset interface of a mobile terminal according to an embodiment of the present disclosure, and the headset interface is a 3.5 mm or 2.5 mm headset jack; FIG. 12 is a schematic circuit diagram of a first switching circuit of a mobile terminal according to the present disclosure; FIG. 13 is a schematic circuit diagram of a second switching circuit of a mobile terminal according to the present disclosure. As shown in FIG. 11, J1 is a headset socket, and a hollow part of headset socket is a headset jack, a fifth pin is a ground pin, a first pin is a left channel pin and is connected to an analog-to-digital conversion (ADC) network using a resistor R2, a second pin is empty, and a third pin is grounded using a resistor R1 and connected to a processor of the mobile terminal, so as to detect whether a headset is inserted. A fourth pin is a microphone pin and is connected to gates of a first PMOS transistor Q1 and a second PMOS transistor Q2 shown in FIG. 13, that is, D3 pins, and a sixth pin of J1 is a right channel pin. As shown in FIG. 13, the second switching circuit includes the first PMOS transistor Q1 and the second PMOS transistor Q2, where the gate of the first PMOS transistor Q1 is connected to the microphone pin of the headset interface of the mobile terminal, a source of the first PMOS transistor Q1 is connected to a voice processor, and a drain of the first PMOS transistor Q1 is connected to a second signal output pin of a processor of the mobile terminal, where the second signal output pin is configured to output a level signal, so as to control on or off of the first PMOS transistor; the gate of the second PMOS transistor Q2 is connected to the microphone pin of the headset interface of the mobile terminal, a source of the second PMOS transistor Q2 is connected to the power supply, where a USB is used as an example herein, and therefore, the source of the second PMOS transistor Q2 is connected to a 5V voltage source of the USB; a drain of the second PMOS transistor Q2 is connected to a third signal output pin of the processor of the mobile terminal. As shown in FIG. 12, the first switching circuit includes an analog switch U1, where a power input pin of the analog switch U1, that is, a ninth pin, is connected to a working voltage; a ground pin, that is, a fourth pin, is grounded; an enabling pin, that is, an eighth pin, is connected to a fourth signal output pin of the processor of the mobile terminal, and may be grounded using a resistor R5; a switching control pin (switching pin that transmits an audio analog signal and an audio digital signal), that is, a tenth pin, is connected to a first signal output pin of the processor of the mobile terminal; an output end of a first data output pin, that is, an output end of a third pin, is connected to the left channel pin of the headset jack of the mobile terminal; and an output end of a second data output pin, that is, an output end of a fifth pin, is connected to the right channel pin of the headset jack of the mobile terminal. The analog switch U1 further includes a first data input pin, that is, a second pin; a second data input pin, that is, a sixth pin; a third data input pin, that is, a seventh pin; and a fourth data input pin, that is, a first pin, where an input end of the first data input pin and an input end of the second data input pin are configured to receive an audio digital signal or an audio data packet, and input ends of the third data input pin and the fourth data input pin are configured to receive an audio analog signal. If an audio digital signal or an audio data packet needs to be output, output of an audio data packet obtained by packing an audio digital signal using the USB is used as an example herein, and an input end of the first data output pin and an input end of the second data output pin are respectively connected to an output end of the first data input pin and an output end of the second data input pin. If an audio analog signal needs to be output, the input end of the first data output pin and the input end of the second data output pin are respectively connected to an output end of the third data input pin and an output end of the fourth data input pin.

Referring to FIG. 11, FIG. 12, and FIG. 13, when no headset is inserted, the third pin and the fourth pin of J1 short-circuit each other, level configuration of the D3 pin of Q1 is a low level, and level configuration of a G1 pin of Q1, that is, GPIO_MIC_EN, is a low level; Q1 is conducted, and an S2 pin of Q1 is connected to the voice processor; when Q1 is conducted, the processor of the mobile terminal detects that level configuration of the third pin of J1, that is, HS_DET, is a high level, which indicates that no headset is in position. When a headset is inserted, the third pin and the fourth pin of J1 are separate, the processor detects that level configuration of the third pin of J1, that is, HS_DET, is pulled down by the resistor R1 to a low level, which indicates that a headset is in position. The ADC network on the right of R2 is connected to the digital-to-analog converter or a common general purpose input/output (GPIO). When a digital-to-analog converter solution is used, the digital-to-analog converter is configured to detect ground impedance of the ADC network, and identify, by detecting the impedance, whether the headset is a common headset such as a monaural headset or a binaural headset, or a multi-channel headset. Ground resistance of an L channel of a common headset is 16 ohms or 32 ohms. As shown in FIG. 12, U1 is an analog switch, of which the third pin is connected to the first pin of J1 in FIG. 11, that is, the left channel pin of the headset jack, and the fifth pin of U1 is connected to the sixth pin of J1, that is, the right channel pin of the headset jack. Ground impedance of a D-pin of the multi-channel headset, that is, the fifth pin of U1, that uses a USB or SPDIF channel to perform transmission is infinite before power-on. When the GPIO is used to perform detection, the GPIO is first set to a pull-up state, 16-ohm resistance of the L channel of the common headset is pulled down to ground, and level configuration of the ADC network changes to a low level. The D-pin of the multi-channel headset, that is, the fifth pin of U1, is approximately empty, and the level configuration of the ADC network keeps a high level. That is, a low level of the ADC network indicates that a headset is a common stereo headset, and a high level of the ADC network indicates that a headset is a multi-channel headset. After identification succeeds, the GPIO is set to a no pull state, such that normal working of a subsequent circuit is not affected by the GPIO.

When detecting that a headset inserted into the headset jack is a common headset, the processor of the mobile terminal controls level configuration of the G1 pin GPIO_MIC_EN of Q1 to be a low level using the first signal output pin, Q1 is conducted, and the microphone pin of J1 is connected to the voice processor using the D3 and S2 pins of Q1; at the same time, the processor controls level configuration of the G1 pin GPIO_USB_5V_EN of Q2 to be a high level using the second signal output pin, and Q2 is disconnected; at the same time, the processor further controls level configuration of the eighth pin GPIO_SWITCH_EN of U1 to be a low level using the third signal output pin, and U1 is enabled; and the processor controls level configuration of the tenth pin GPIO_SWITCH_SW of U1 to be a low level using the fourth signal output pin, such that the first pin and the seventh pin of U1 are respectively conducted to the third pin and the fifth pin of U1; in this case, the ground pin of the headset jack works normally, the microphone pin is connected to the voice processor, and an audio analog signal transmission channel is conducted and starts to transmit an audio analog signal.

When detecting that a headset inserted into the headset jack is a multi-channel headset, the processor controls level configuration of the G1 pin GPIO_MIC_EN of Q1 to be a high level using the first signal output pin, Q1 is disconnected; at the same time, the processor controls level configuration of the G1 pin GPIO_USB_5V_EN of Q2 to be a low level using the second signal output pin, Q2 is conducted, and external USB 5V power supply is enabled to supply power to the multi-channel headset using the microphone pin of the headset jack; at the same time, the processor controls the eighth pin GPIO_SWITCH_EN of U1 to be a low level using a third signal control pin, and U1 is enabled; and the processor controls level configuration of the tenth pin GPIO_SWITCH_SW of U1 to be a high level using a fourth signal control pin, such that the second pin and the sixth pin of U1 are respectively conducted to the third pin and the fifth pin of U1. In this case, the ground pin of the headset jack works normally, a USB 5V voltage is input from the microphone pin to supply power to the multi-channel headset, and an audio digital signal or audio data packet transmission channel is conducted and starts to transmit an audio digital signal or an audio data packet, that is, to perform USB data transmission. In this way, transmission and play of different types of audio files, and compatibility with different types of headsets are implemented. The first to the fourth signal output pins of the processor of the mobile terminal may be a same pin, or may be different pins. During configuration, a NOT gate may be configured on different branch circuits according to control requirements, such that a high level and a low level are separately output on different branch circuits; or branch circuits with a same level may share one output pin according to control requirements; or, four signals directly output are corresponding to four output pins, which is not limited herein.

It should be noted that the embodiments in this specification are all described in a progressive manner, each embodiment focuses on a difference from other embodiments, and for same or similar parts in the embodiments, reference may be made to these embodiments. An apparatus embodiment is basically similar to a method embodiment, and therefore is described briefly; for related parts, reference may be made to partial descriptions in the method embodiment.

According to the description of the foregoing embodiments, the present disclosure has the following advantages.

A type of a headset connected to a headset interface is determined, and a different transmission channel may be used according to the type of the headset to transmit a different type of signal; for a multi-channel headset, an audio digital signal is transmitted, and for a headset that is not a multi-channel headset, an audio analog signal is transmitted, thereby implementing an effect that a mobile terminal is compatible with different types of headsets, and cooperate with the different types of headsets to transmit different types of audio files. This can implement normally playing a multi-channel audio file, and enable a multi-channel headset end to output a multi-channel surround sound.

A person of ordinary skill in the art may understand that all or some of the processes of the methods in the embodiments may be implemented by a computer program instructing relevant hardware. The program may be stored in a computer readable storage medium. When the program runs, the processes of the methods in the embodiments are performed. The storage medium may be a magnetic disk, an optical disc, a read-only memory (ROM), or a random access memory (RAM).

What is disclosed above is merely exemplary embodiments of the present disclosure, and is not intended to limit the protection scope of the present disclosure. Therefore, equivalent variations made in accordance with the claims of the present disclosure shall fall within the scope of the present disclosure.

What is claimed is:

1. A mobile terminal, comprising:
- a processor;
- a first switching circuit coupled to the processor;
- a digital-to-analog converter coupled to the processor and the first switching circuit; and
- a headset interface coupled to the first switching circuit,
- wherein the first switching circuit is connected to the headset interface,
- wherein the processor is configured to:
  - decode an audio file to obtain an audio digital signal;
  - determine a type of a headset connected to the headset interface;
  - generate a first switching instruction according to the type of the headset; and
  - transmit the first switching instruction to the first switching circuit,
- wherein the first switching instruction carries indication information used to instruct the first switching circuit to transmit the audio digital signal to the headset interface when the headset is a multi-channel headset,
- wherein the first switching instruction carries indication information used to instruct the first switching circuit to transmit an audio analog signal to the headset interface when the headset is not a multi-channel headset,
- wherein the digital-to-analog converter is configured to:
  - receive the audio digital signal from the processor; and
  - convert the audio digital signal into the audio analog signal,
- wherein the first switching circuit is configured to:
  - receive the first switching instruction; and
  - transmit the audio digital signal or the audio analog signal to the headset interface according to the first switching instruction,
- wherein the headset interface is configured to transmit the audio digital signal to the headset or transmit the audio analog signal to the headset,
- wherein the headset interface is a 3.5 millimeter (mm)/2.5 mm headset jack,
- wherein the headset jack comprises a left channel pin and a right channel pin,
- wherein the first switching circuit comprises an analog switch,
- wherein a power input pin of the analog switch is connected to a working voltage,
- wherein a ground pin of the analog switch is grounded,
- wherein a switching control pin of the analog switch is connected to a first signal output pin of the processor of the mobile terminal and is configured to receive the first switching instruction output by the processor, wherein an output end of a first data output pin of the analog switch is connected to the left channel pin of the headset interface of the mobile terminal, wherein an output end of a second data output pin of the analog switch is connected to the right channel pin of the headset interface of the mobile terminal, wherein the analog switch further comprises a first data input pin, a second data input pin, a third data input pin, and a fourth data input pin, wherein an input end of the first data input pin and an input end of the second data input pin are configured to receive the audio digital signal or an audio data packet, wherein input ends of the third data input pin and the fourth data input pin are configured to receive the audio analog signal, wherein an input end of the first data output pin and an input end of the second data output pin are respectively connected to an output end of the first data input pin and an output end of the second data input pin when an audio digital signal or the audio data packet needs to be output, and wherein the input end of the first data output pin and the input end of the second data output pin are respectively connected to an output end of the third data input pin and an output end of the fourth data input pin when an audio analog signal needs to be output.

2. The mobile terminal according to claim 1, wherein the processor is further configured to pack the audio digital signal into the audio data packet and directly send the audio data packet to the headset interface using the first switching circuit, and wherein the headset interface is configured to transmit the audio data packet to the headset.

3. The mobile terminal according to claim 2, wherein the processor is further configured to perform multi-channel sound processing on the audio digital signal after obtaining the audio digital signal and before packing the audio digital signal into the audio data packet.

4. The mobile terminal according to claim 1, wherein the first switching circuit is configured to transmit the audio digital signal or the audio analog signal to a sound channel pin of the headset interface.

5. The mobile terminal according to claim 1, wherein the headset interface is a wired connection interface, wherein the mobile terminal further comprises a headset identification circuit, wherein the headset identification circuit is connected to the processor and is configured to detect a ground impedance of a headset pin or a voltage value of a voltage detection point disposed on a headset pin when the headset is inserted into the headset interface, and wherein the processor is further configured to identify the type of the headset according to the ground impedance or the voltage value.

6. The mobile terminal according to claim 1, wherein the headset interface is a wireless connection interface, and wherein the processor is further configured to:

receive headset type indication information sent by the headset; and determine the type of the headset according to the headset type indication information.

7. The mobile terminal according to claim 1, further comprising an input interface configured to receive headset type indication information entered by a user, wherein the processor is further configured to:

acquire the headset type indication information; and determine the type of the headset according to the headset type indication information.

8. The mobile terminal according to claim 1, wherein the processor decodes the audio file to obtain the audio digital signal after identifying the type of the headset and sending the first switching instruction.

9. A mobile terminal comprising:

a voice processor;

a power supply;

a second switching circuit;

a processor;

a first switching circuit coupled to the processor;

a digital-to-analog converter coupled to the processor and the first switching circuit; and a headset interface coupled to the first switching circuit, wherein the first switching circuit is connected to the headset interface, wherein the processor is configured to:

decode an audio file to obtain an audio digital signal;

determine a type of a headset connected to the headset interface;

generate a first switching instruction according to the type of the headset; and transmit the first switching instruction to the first switching circuit, wherein the first switching instruction carries indication information used to instruct the first switching circuit to transmit the audio digital signal to the headset interface when the headset is a multi-channel headset, wherein the first switching instruction carries indication information used to instruct the first switching circuit to transmit an audio analog signal to the headset interface when the headset is not a multi-channel headset, wherein the digital-to-analog converter is configured to:

receive the audio digital signal from the processor; and convert the audio digital signal into the audio analog signal, wherein the first switching circuit is configured to:

receive the first switching instruction; and transmit the audio digital signal or the audio analog signal to the headset interface according to the first switching instruction, wherein the headset interface is configured to transmit the audio digital signal to the headset or transmit the audio analog signal to the headset, wherein the voice processor is configured to process sound information received from a microphone pin of the headset interface, wherein the processor is further configured to output a second switching instruction to the second switching circuit according to the type of the headset connected to the headset interface, wherein the second switching instruction instructs the second switching circuit to connect the power supply and the microphone pin of the headset interface when the headset is the multi-channel headset, wherein the second switching instruction instructs the second switching circuit to connect the voice processor and the microphone pin of the headset interface when the headset is not the multi-channel headset, and wherein the second switching circuit is connected to the microphone pin of the headset interface and is configured to receive the second switching instruction and switch the microphone pin of the headset interface according to the second switching instruction, such that the microphone pin of the headset interface is connected to the voice processor or the power supply.

10. The mobile terminal according to claim 9, wherein the headset interface is a 3.5 mm/2.5 mm headset jack, wherein the second switching circuit comprises a first p-channel metal-oxide-semiconductor (PMOS) transistor and a second PMOS transistor, wherein a gate of the first PMOS transistor is connected to the microphone pin of the headset interface of the mobile terminal, wherein a source of the first PMOS transistor is connected to the voice processor, wherein a drain of the first PMOS transistor is connected to a second signal output pin of the processor of the mobile terminal, wherein the second signal output pin is configured to output a level signal, so as to control on or off of the first PMOS transistor, wherein a gate of the second PMOS transistor is connected to the microphone pin of the headset interface of the mobile terminal, wherein a source of the second PMOS transistor is connected to the power supply, wherein a drain of the second PMOS transistor is connected to a third signal output pin of the processor of the mobile terminal, and wherein the third signal output pin is configured to output a level signal, so as to control on or off of the second PMOS transistor.

11. A transmission method, applied to a mobile terminal provided with a headset interface, wherein the method comprises:

decoding an audio file to obtain an audio digital signal;

determining a type of a headset connected to the headset interface;

generating a first switching instruction according to the type of the headset, wherein the first switching instruction carries indication information used to transmit the audio digital signal to the headset interface when the headset is a multi-channel headset, and wherein the first switching instruction carries indication information used to transmit an audio analog signal to the headset interface when the headset is not a multi-channel headset;

converting the audio digital signal into the audio analog signal; and transmitting an audio digital signal to the headset using the headset interface according to the first switching instruction, wherein the headset interface is a 15 millimeter (mm)/2.5 mm headset jack, wherein the headset jack comprises a left channel pin and a right channel pin, wherein a power input pin of an analog switch is connected to a working voltage, wherein a ground pin of the analog switch is grounded, wherein a switching control pin of the analog switch is connected to a first signal output pin of a processor of the mobile terminal and is configured to receive the first switching instruction, wherein an output end of a first data output pin of the analog switch is connected to the left channel pin of the headset interface of the mobile terminal, wherein an output end of a second data output pin of analog switch is connected to the right channel pin of the headset interface of the mobile terminal, wherein the analog switch further comprises a first data input pin, a second data input pin, a third data input pin, and a fourth data input pin, wherein an input end of the first data input pin and an input end of the second data input pin are configured to receive the audio digital signal or an audio data packet, wherein input ends of the third data input pin and the fourth data input pin are configured to receive the audio analog signal, wherein an input end of the first data output pin and an input end of the second data output pin are respectively connected to an output end of the first data input pin and an output end of the second data input pin when an audio digital signal or the audio data packet needs to be output, and wherein the input end of the first data output pin and the input end of the second data output pin are respectively connected to an output end of the third data input pin and an output end of the fourth data input pin when an audio analog signal needs to be output.

12. The method according to claim 11, further comprising decoding a to-be-processed audio file to obtain the audio digital signal, wherein transmitting the audio digital signal to the headset comprises:

packing the audio digital signal into the audio data packet; and transmitting the audio data packet to the headset using the headset interface.

13. The method according to claim 12, wherein before packing the audio digital signal into the audio data packet, the method further comprises performing multi-channel sound processing on the audio digital signal, and wherein packing the audio digital signal into the audio data packet comprises packing the audio digital signal obtained after multi-channel sound processing is performed into the audio data packet.

14. The method according to claim 11, wherein the audio digital signal or the audio analog signal is transmitted to the headset using the headset interface, and wherein the transmission is performed using a sound channel pin of the headset interface.

15. The method according to claim 11, wherein determining the type of the headset connected to the headset interface comprises:

detecting a ground impedance of a headset pin or a voltage value of a voltage detection point disposed on a headset pin when the headset is inserted into the headset interface; and identifying the type of the headset according to the ground impedance or the voltage value.

16. The method according to claim 11, wherein determining the type of the headset connected to the headset interface comprises:

receiving headset type indication information entered by a user or sent by the headset; and determining the type of the headset according to the headset type indication information.

* * * * *